US008852068B2

(12) United States Patent
Kauppila

(10) Patent No.: US 8,852,068 B2
(45) Date of Patent: Oct. 7, 2014

(54) TUBE IN A TUBE MECHANICAL FOLDING ROLL

(75) Inventor: Greg M. Kauppila, Ashland, WI (US)

(73) Assignee: C.G. Bretting Manufacturing Co., Inc., Asland, WI (US)

( * ) Notice: Subject to any disclaimer, the term of this patent is extended or adjusted under 35 U.S.C. 154(b) by 767 days.

(21) Appl. No.: 13/091,726

(22) Filed: Apr. 21, 2011

(65) Prior Publication Data

US 2012/0270716 A1 Oct. 25, 2012

(51) Int. Cl.
*B31B 1/56* (2006.01)
*B65H 27/00* (2006.01)

(52) U.S. Cl.
CPC ..... *B65H 27/00* (2013.01); *B65H 2406/332* (2013.01); *B65H 2406/331* (2013.01); *B65H 2406/3614* (2013.01); *B65H 2402/522* (2013.01); *B65H 2404/1372* (2013.01)
USPC ..... 493/454; 493/442; 493/450

(58) Field of Classification Search
CPC ..... B65H 27/00; B65H 2406/331; B65H 2406/332; B65H 2406/1372; B65H 2406/3614; B31B 1/26; B31B 1/52; B31B 1/54; B31B 1/74
USPC ..... 493/442, 445, 450, 454; 384/563; 137/1
See application file for complete search history.

(56) References Cited

U.S. PATENT DOCUMENTS

| | | | | |
|---|---|---|---|---|
| 712,664 | A | 11/1902 | Gage | |
| 3,037,557 | A | 6/1962 | Faeber et al. | |
| 3,142,428 | A | 7/1964 | Faeber | |
| 3,861,254 | A | 1/1975 | Stoffels et al. | |
| 4,190,241 | A | 2/1980 | Krueger | |
| 4,207,998 | A | 6/1980 | Schmid | |
| 4,254,947 | A | 3/1981 | Trogan | |
| 4,494,741 | A | 1/1985 | Fischer et al. | |
| 5,230,456 | A | 7/1993 | Germann et al. | |
| 5,358,163 | A | 10/1994 | Naka | |
| 5,393,290 | A * | 2/1995 | Lehmann et al. | 492/16 |
| 5,813,959 | A | 9/1998 | Hader et al. | |
| 6,250,581 | B1 | 6/2001 | Cramer | |
| 6,296,601 | B1 | 10/2001 | Couturier | |
| 6,488,194 | B1 | 12/2002 | Couturier | |
| 6,585,139 | B1 | 7/2003 | Holtmann et al. | |
| 7,367,264 | B2 | 5/2008 | Beaudry | |
| 7,458,927 | B2 | 12/2008 | Kauppila et al. | |
| 7,963,037 | B2 * | 6/2011 | Garben | 29/895.2 |
| 8,241,192 | B2 * | 8/2012 | Sano et al. | 492/15 |
| 2004/0159999 | A1 * | 8/2004 | Dematteis | 271/264 |
| 2005/0082332 | A1 | 4/2005 | White | |
| 2007/0090227 | A1 * | 4/2007 | Sano | 242/547 |
| 2012/0065045 | A1 * | 3/2012 | De Matteis | 493/442 |

FOREIGN PATENT DOCUMENTS

| | | | |
|---|---|---|---|
| DE | 10 2006 018654 | A1 | 10/2007 |
| EP | 1 449 799 | A1 | 8/2004 |

* cited by examiner

*Primary Examiner* — Hemant M Desai
(74) *Attorney, Agent, or Firm* — Reinhart, Boerner, & Van Deuren, P.C.

(57) ABSTRACT

A processing roll having rotatable outer tube mounted on a non-rotatable inner tube by a fluid valving arrangement, is provided. The fluid valving arrangement provides angularly controlled transfer of fluid between a cavity on the inside of the inner tube and ports distributed longitudinally along an outer surface of the outer tube, while also providing distributed bearing support of either the outer tube on the inner tube, or the inner tube on the outer tube, at a plurality of locations along a longitudinal axis of the processing roll.

49 Claims, 13 Drawing Sheets

TUBE IN A TUBE MECHANICAL FOLDING ROLL

FIELD OF THE INVENTION

This invention relates to the support and operation of elongated rotating rolls, and more particularly to the support and operation of elongated rotating rolls having fluid passages therein, such as web directing and folding rolls of the type used for processing paper products.

BACKGROUND OF THE INVENTION

Paper processing operations often utilize machinery having elongated rotating rolls, which may be several meters in length, for transporting a web of material, cutting the web into individual sheets, and folding or interfolding the individual sheets into a desired folded pattern. Such rolls typically rotate at high speed and are generally of a robust construction having considerable weight. Adjacent rolls often interact with one another in a manner which subjects the roll to considerable side loading and/or bending loading. Such rolls also typically include fluid passages therein, for applying vacuum and/or compressed air to rows of fluid ports disposed in one or more arrays along an angular portion of the periphery of the roll. Even where only vacuum, or low pressure air is applied to the fluid ports over the angular portion of the roll, the length of such rolls results in considerable additional bending loads being applied along the axis of the roll as a result of the vacuum and/or fluid pressure.

In the past, elongated rolls of the type used in the paper processing industry have typically relied more-or-less completely upon bearings disposed at opposite axial ends of the roll to provide rotational support of the roll. Such support arrangements utilizing bearings located at opposite axial ends of a roll are disclosed in: U.S. Pat. No. 5,230,456 to German; U.S. Pat. No. 7,367,264 to Beaudry; U.S. Pat. No. 6,585,139 to Holtmann; U.S. Pat. No. 4,190,241 to Kreuger; U.S. Pat. No. 6,488,194 to Couturier; U.S. Pat. No. 6,296,601 to Couturier; and U.S. Pat. No. 4,254,947 to Trogan.

Where operation of a roll supported solely at opposite axial ends required the provision of vacuum or air pressure at fluid ports located along the outer periphery of the roll, two prior approaches have been utilized. In one approach, as exemplified by U.S. Pat. No. 5,230,456 to German and U.S. Pat. No. 6,585,139 to Holtmann, vacuum and/or air pressure is provided through a stationary inner tube about which the roll rotates on bearings disposed at opposite axial ends of the roll. Typically, non-load bearing, radially extending walls affixed to the inner tube define a suction box area, or a pressure box area over an angular portion of the space between the stationary inner tube and the roll. This type of arrangement does not lend itself well to use in rolls rotating at high speed and having considerable lengths. In addition, where the operation performed by the roll includes gripping or folding a sheet passing over the roll, or for rolls having cutting blades mounted therein, a suction or pressure box structure cannot typically be used, because cutting blades, grippers and tucker elements of the folding rolls must typically be housed within the periphery of the roll. Even where such elements are not required to extend into the roll, the prior structures utilizing suction or pressure boxes are simply not structurally stiff and strong enough for operation at the high rotational speeds and with the substantial side loads required for economical operation in modern paper processing operations.

Prior roll structures utilizing suction or pressure boxes are also typically not capable of providing the sophisticated degree of control of vacuum necessary for modern paper processing operations. In such operations, for example, it may be necessary to apply vacuum at several positions around the periphery of the roll.

A more modern approach to providing vacuum and/or pressure to ports or operating elements disposed along the length of elongated rolls used in modern paper processing is illustrated by: U.S. Pat. No. 4,254,947 to Trogan; U.S. Pat. No. 6,296,601 to Couturier; and U.S. Pat. No. 6,488,194 to Couturier. In these more modern approaches, a roll is supported for rotation at high speed by bearings disposed at opposite axial ends of the roll. The roll includes one or more fluid passages extending longitudinally into the roll from one or both ends of the rolls. These longitudinally extending fluid passages are connected within the roll to radially extending passages opening through the outer periphery of the roll, or connecting with air-actuated elements mounted within the periphery of the roll at various locations along the longitudinal length of the roll.

A vacuum timing device, having one or more circumferentially shaped grooves abuts one or both axial ends of the roll, for directing fluid or applying vacuum to the axial ends of the longitudinally extending bores within the roll over a desired angular portion of the rotation of the roll. While this arrangement generally has worked well, this approach imposes certain structural and physical limitations on the operational speed of the processing machinery and methods.

As the length of rolls utilized for processing paper has increased, it has become increasingly difficult to build enough strength and stiffness into the complex profiles used in modern paper processing rolls for high speed operation with the rolls supported only at opposite axial ends thereof. Also, because dynamic loads inherent in the operation of rotating machinery increase at an exponential rate with an increase in speed, it has become increasingly difficult to build rolls having the highly convoluted shapes required to accommodate internal gripping, cutting and tucking structures, without compromising operation or structural strength of the roll arrangement.

Another undesirable limitation of the present approach of having vacuum and/or pressure applied through a timing device disposed at one or both axial ends of a rotating roll derives from the fact that it takes too long for vacuum to become uniform, or pressure to build along the extended longitudinal length of the roll speeds and widths increase. Stated another way, the prior arrangements have too much time lag and resistance to fluid flow for operation at increased speeds and over ever longer roll widths as is desirable to continue advancement and enhancement of the output rate and quality of products being produced with the roll.

It is desirable, therefore, to address one or more of the problems and limitations described above with present processing rolls in an improved roll apparatus and method. Specifically, it is desirable to provide a new rotating roll and apparatus capable of operating at higher speeds and with greater roll lengths. Where the operation of the roll requires provision of vacuum, air, or other fluids at ports extending from the surface of the roll at selected angular locations along the longitudinal length of the roll, it is desirable to provide an improved apparatus and method for enhancing fluid flow in a manner more amenable to accurate control, with less time lag and more uniform application along an entire array of such fluid ports.

BRIEF SUMMARY OF THE INVENTION

The invention provides an improved processing roll having rotatable outer tube mounted about a non-rotatable inner tube by a fluid valving arrangement. The fluid valving arrangement provides angularly controlled transfer of fluid between a cavity on the inside of the inner tube and ports distributed longitudinally along an outer surface of the outer tube, while also providing distributed bearing support of the outer tube on the inner tube at a plurality of locations along a longitudinal axis of the roll, in some forms of the invention, and distributed bearing support of the inner tube on the outer tube at a plurality of locations along a longitudinal axis of the roll, in other forms of the invention.

In some forms of the invention, the fluid valving arrangement is attached to the inner tube, and is not rotatable. In other forms of the invention, the fluid valving arrangement is at least partially mounted on the outer tube, and rotates with the outer tube.

In one form of the invention, a folding roll apparatus includes a non-rotatable inner tube, a rotatable outer tube disposed about the inner tube, and a vacuum valving arrangement disposed between the inner and outer tubes. The non-rotatable inner tube extends along a longitudinal axis. The rotatable outer tube is disposed about the inner tube for rotation about the longitudinal axis, with the inner and outer tubes defining an elongated annular space between the inner and outer tubes. The elongated annular space between the inner and outer tube includes a longitudinally elongated vacuum transfer zone disposed at a predetermined relative angular positioning of the outer tube with respect to the inner tube. The vacuum valving arrangement is disposed in the elongated annular space between the inner and outer tubes.

The inner tube defines an elongated vacuum plenum therewithin, extending along the longitudinal axis between the elongated vacuum transfer zone. The inner tube has at least one vacuum port disposed therein in a manner providing fluid communication between the vacuum transfer zone and the vacuum plenum.

The outer tube includes a plurality of vacuum ports distributed along the longitudinal axis on outer surface of the outer tube, and connected in fluid communication with the annular space between the inner and outer tubes.

The vacuum valving arrangement is configured for providing angularly controlled transfer of vacuum from the vacuum plenum inside of the inner tube to the vacuum ports distributed longitudinally along the outer surface of the outer tube. The vacuum valving arrangement is also configured for providing distributed bearing support of one of the outer tube and the inner tube on the other of the outer tube and the inner tube at a plurality of locations along the longitudinal axis within the longitudinally elongated vacuum transfer zone.

In some forms of the invention, the vacuum valving arrangement provides the sole bearing support for one of the outer tube and the inner tube on the other of the outer tube and the inner tube. This eliminates the need for additional bearing elements at the ends of the roll apparatus, of the type required for prior processing roll apparatuses and methods. As a result, complexity and limitations on rotational speed and roll length imposed by prior arrangements are eliminated, and roll capability and performance are substantially enhanced through practice of the invention.

In some forms of the invention, the vacuum valving arrangement provides the distributed bearing support for one of the outer tube and the inner tube on the other of the outer tube and the inner tube in combination with additional bearing support provided by bearing elements at one or both ends of the roll apparatus. This substantially reduces the loads that need to be supported by bearing elements at the ends of the roll apparatus, of the type required for prior processing roll apparatuses and methods. As a result, complexity and limitations on rotational speed and roll length imposed by prior arrangements are eliminated, and roll capability and performance are substantially enhanced through practice of the invention.

In some forms of the invention, the non-rotatable inner tube has a wall of the inner tube defining the elongated vacuum plenum within the inner tube. The wall further defines a plurality of vacuum ports extending through the wall of the inner tube at a plurality of locations in the vacuum transfer zone along the longitudinal axis. The rotatable outer tube has a wall of the outer tube extending along the longitudinal axis and defining the plurality of vacuum ports extending through the outer tube wall at a plurality of locations along the longitudinal axis. The vacuum valving arrangement comprises a plurality of bearing elements disposed along the vacuum transfer zone and angularly affixed to one of the inner and outer tubes for providing operative bearing contact between the walls of the inner and outer tubes to journal the outer tube on the inner tube. The vacuum valving arrangement also includes a seal arrangement angularly affixed to one of the inner and outer tubes for defining the vacuum transfer zone and providing fluid communication between the vacuum chamber and the vacuum ports in the outer surface of the outer tube when the vacuum ports through the walls of the inner and outer tubes are disposed in alignment with one another in the vacuum transfer zone.

In some forms of the invention, the vacuum ports in the inner tube are axially spaced from one another along the longitudinal axis and at least one of the bearing elements extends at least partly over one of the vacuum ports in the inner tube to form an at least partly covered vacuum port in the inner tube. The at least one bearing element also has a vacuum passage extending through the element and providing fluid communication through the bearing element to the at least partly covered vacuum port, when the vacuum passes through the at least one bearing element is aligned with the at least one partly covered vacuum port in the inner tube. The vacuum ports in the inner tube may be axially spaced from one another along the longitudinal axis. At least some of the bearing elements may be at least partially longitudinally disposed between adjacent ones of the vacuum ports in the inner tube.

In some forms of the invention wherein the vacuum valving arrangement is affixed to the inner tube and is not rotatable, the vacuum ports in the inner tube are axially spaced from one another along the longitudinal axis, and at least some of the bearing elements are at least partially longitudinally disposed between adjacent vacuum ports in the inner tube.

Where the vacuum valving arrangement is affixed to the inner tube and not rotatable, the seal arrangement may include first and second longitudinally extending seal elements, and may further include first and second circumferentially extending seal elements. The longitudinal and circumferentially extending seal elements are operatively mounted on the inner tube and joined in combination with one another to define and sealingly encompass the vacuum transfer zone bounded by the seal elements. The first and second longitudinally extending seal elements may define respective first and second axial ends thereof, with the first axial ends of the first and second longitudinally extending seals being juxtaposed and operatively connected by a first circumferentially extending seal element. The second axial ends of the first and second longitudinally extending seals may likewise be juxtaposed with one another and operatively connected by the second circumferentially extending seal element.

In some forms of the invention, a vacuum port disposed in the vacuum transfer zone may take the form of a circumferentially extending slot to allow communication of vacuum through the wall of the inner tube over an angular arc of the wall of the inner tube.

In some forms of the invention having the seal arrangement affixed to the inner tube to define the vacuum transfer zone, at least one of the bearing elements may be disposed within the vacuum transfer zone. At least two of the vacuum ports in the inner tube may be disposed in a longitudinally spaced relationship to one another within the vacuum zone, in such a manner that the at least one bearing element in the vacuum transfer zone is longitudinally disposed between the two vacuum ports within the vacuum transfer zone.

In some forms of the invention, the inner tube defines a plurality of vacuum ports therein disposed in a longitudinally spaced array with respect to one another within the vacuum transfer zone to form one or more pairs of adjacent longitudinally spaced vacuum ports of the inner tube. At least one bearing element of the bearing arrangement is longitudinally disposed between the vacuum ports of each pair of adjacent vacuum ports within the vacuum transfer zone. In some forms of the invention, the vacuum port of the inner tube disposed in the vacuum transfer zone adjacent the bearing element within the vacuum transfer zone may be a circumferentially extending slot to allow communication of vacuum through the wall of the inner tube over an annular arc of the wall of the inner tube. In some forms of the invention, all of the vacuum ports in the longitudinally spaced array forming pairs of adjacent vacuum ports of the inner tube may be circumferentially extending slots to allow passage of vacuum through the wall of the inner tube over angular arcs of the wall of the inner tube.

In some forms of the invention having bearing elements attached to the inner tube, the bearing arrangement may include a plurality of curved bearing pads extending partly around and individually attached to the outer surface of the inner tube in a circumferentially and longitudinally spaced relationship to one another, to thereby provide distributed support for the outer tube on the inner tube through 360° of rotation of the outer tube. In some forms of the invention, some or all of the plurality of curved bearing pads may be axially aligned with one another in a spaced relationship along the longitudinal axis. At least two of the curved bearing pads may be axially aligned with one another within the vacuum transfer zone. In some forms of the invention, the plurality of bearing pads forms three axially aligned rows of bearing pads with the rows being attached to the inner tube in an evenly circumferentially spaced relationship to one another. One of the three axially aligned rows of bearing pads may be disposed within the vacuum transfer zone.

In some forms of the invention, at least one bearing element of the vacuum transfer arrangement may have a cylindrical shape disposed about the inner tube in the annular space between the inner and outer tubes. In some forms of the invention, the cylindrical shaped bearing element may be attached to and rotate with the outer element.

In some forms of the invention, a plurality of cylindrical shaped bearing elements may be axially spaced from one another along the longitudinal axis, and attached to and rotate with the outer tube. At least one of the plurality of cylindrical shaped bearing elements may be axially retained at a position along the longitudinal axis by an axial positioning arrangement operatively connecting the at least one cylindrical shaped bearing arrangement to the inner shaft.

A cylindrical shaped bearing element, according to the invention, may also comprise at least part of a sealing arrangement according to the invention. In some forms of the invention, at least one of the cylindrical shaped bearing elements may be disposed over at least one of the vacuum ports in the inner tube, to thereby form a cylindrical-shaped bearing/seal element that operatively seals at least a portion of the junctures of the inner and outer tubes with the cylindrical-shaped bearing/seal element. The cylindrical-shaped bearing/seal element may be attached to and rotate with the outer tube. An apparatus, according to the invention, may also include a bearing/seal retention key extending through the outer tube and into engagement with the cylindrical-shaped bearing/seal element in a manner securing the cylindrical-shaped bearing/seal element to the outer tube for rotation therewith.

In some forms of the invention, a cylindrical-shaped bearing/seal element may further include a longitudinally extending slot in an outer surface thereof configured for sliding passage of the retention key through the slot as the inner tube is axially installed into the outer tube and further configured to angularly secure the cylindrical-shaped bearing/seal element to the outer shaft for rotation therewith. In forms of the invention having a plurality of cylindrical-shaped bearing/seal elements disposed about the inner tube, a plurality of bearing/seal retention keys engaging each of the cylindrical-shaped bearing/seal elements may be arranged in a spaced relationship to one another along the longitudinal axis, and aligned angularly to form an interrupted key arrangement for aligning the longitudinally extending slots in all of the cylindrical-shaped bearing/seal elements with one another.

In some forms of the invention having cylindrical-shaped bearing/seal elements, the bearing/seal elements may be axially retained at a position along the longitudinal axis by an axial positioning arrangement operatively connecting the cylindrical-shaped bearing/seal element to the inner shaft. An axial positioning element, in some forms of the invention, may include a retaining ring groove in the inner tube adjacent an axial end of the cylindrical-shaped bearing/seal element, and a retaining ring disposed in the groove and bearing against the axial end of the cylindrical-shaped bearing/seal element.

The cylindrical-shaped bearing/seal elements may be axially retained within the vacuum transfer zone whereat the cylindrical-shaped bearing/seal element covers and seals around a corresponding vacuum port in the inner tube. The cylindrical-shaped bearing/seal element includes a vacuum passage therein in fluid communication with a corresponding vacuum port in the outer tube and providing fluid communication between the corresponding vacuum port in the outer tube and the corresponding vacuum port in the inner tube, when the vacuum passage of the cylindrical-shaped bearing/seal element is in alignment with the corresponding vacuum port in the inner tube. Such an apparatus, in some forms of the invention, may further include a bearing/seal retention key extending through the outer tube and into engagement with the cylindrical-shaped bearing/seal element in a manner securing the cylindrical-shaped bearing/seal element to the outer tube for rotation therewith, and also in a manner securing the cylindrical-shaped bearing/seal arrangement to the outer tube in an orientation whereat the vacuum passage in the cylindrical-shaped bearing/seal arrangement is disposed in fluid communication with the vacuum port in the outer tube.

In one form of the invention, both fluid communication between a fluid source and fluid ports on an outer surface of a rotatable processing roll and distributed bearing support of the processing roll along the longitudinal length of the processing roll are provided, by rotatably supporting an outer tube of the processing roll on a non-rotating inner tube of the processing roll with a fluid valving arrangement. The fluid valving arrangement is configured for providing angularly controlled transfer of fluid between a cavity on the inside of the inner tube and the fluid ports distributed longitudinally along an outer surface of the outer tube. The cavity is connected to the fluid source. The fluid valving arrangement also provides distributed bearing support of one of the outer tube and the inner tube on the other of the outer tube and the inner tube at a plurality of locations along a longitudinal axis of the processing roll.

The non-rotatable inner tube may extend along the longitudinal axis, with the rotatable outer tube being disposed about the inner tube for rotation about the longitudinal axis, in such a manner that the inner and outer tubes define an elongated annular space between inner and outer tubes. The annular space includes a longitudinally elongated fluid transfer zone at a predetermined relative angular positioning of the outer tube with respect to the inner tube. The fluid valving arrangement is disposed in the angular elongated space between the inner and outer tubes. The inner tube defines an elongated fluid plenum therewithin, extending along the longitudinal axis beneath the elongated fluid transfer zone, with the inner tube having at least one fluid port disposed therein and providing fluid communication between the fluid transfer zone and the fluid plenum. The outer tube includes a plurality of fluid ports distributed along the longitudinal axis on an outer surface of the outer tube and connected in fluid communication with the annular space between the inner and outer tubes. The fluid valving arrangement is configured for providing angularly controlled transfer of fluid from the fluid plenum inside of the inner tube to the fluid ports along the outer surface of the outer tube. The fluid valving arrangement is also configured for providing distributed bearing support of one of the outer tube and the inner tube on the other of the outer tube and the inner tube at a plurality of locations along the longitudinally elongated fluid transfer zone.

In some forms of the invention, a processing roll apparatus provides both fluid communication between a fluid source and fluid ports on the outer surface of a rotatable processing roll, and also provides distributed bearing support of the processing roll along a longitudinal length of the processing roll. Such an apparatus, according to the invention, may include a rotatable outer tube of the processing roll, supported on a non-rotating inner tube toward of the processing roll by a fluid valving arrangement. The fluid valving arrangement is configured for providing angularly controlled transfer of fluid between a cavity on the inside of the inner tube and the fluid ports along the outer surface of the outer tube. A cavity is adapted for connection to a fluid source. The fluid valving arrangement is also configured to provide such angularly controlled transfer of fluid while providing distributed bearing support of one of the outer tube and the inner tube on the other of the outer and the inner tube at a plurality of locations along a longitudinal axis of the processing roll.

The non-rotatable inner tube may extend along the longitudinal axis with the rotatable outer tube disposed about the inner tube for rotation about the longitudinal axis. The inner and outer tubes define an elongated angular space between the inner and outer tubes, including a longitudinally elongated fluid transfer zone at a predetermined relative angular positioning of the outer tube with respect to the inner tube. The fluid valving arrangement is disposed in the elongated angular space between the inner and outer tubes. The inner tube defines an elongated fluid plenum therewithin, extending along the longitudinal axis beneath the elongated fluid transfer zone. The inner tube has at least one fluid port disposed therein and providing fluid communication between the fluid transfer zone and the fluid plenum. The outer tube includes a plurality of fluid ports distributed along the longitudinal axis on an outer surface of the outer tube and connected in fluid communication with the annular space between the inner and outer tubes. The fluid valving arrangement is configured for providing angularly controlled transfer of fluid from the fluid plenum inside of the inner tube to the fluid ports distributed along the outer surface of the outer tube. The fluid valving arrangement is also configured for providing distributed bearing support of one of the outer tube and the inner tube on the other of the outer tube and the inner tube at a plurality of locations along the longitudinally elongated fluid transfer zone.

The invention may also take the form of a method or apparatus for providing distributed bearing support to an elongated rotatable roll defining a longitudinal axis of the roll and having an outer tube disposed about an inner tube. The method may include journalling one of the outer and inner tubes on the other of the outer and inner tubes of the roll along the longitudinal axis. When arranged in this manner, the inner and outer tubes define a longitudinally extending annular space between the inner and outer tubes of the roll, with the distributed bearing arrangement being disposed in the annular space and having a plurality of axially spaced separately replaceable substantially cylindrical-shaped bearing element secured to the outer member for rotation therewith.

Such a method or apparatus may further include securing the plurality of bearing elements to the inner member in an axially spaced relationship to one another along the longitudinal axis, in a manner precluding axial movement of the bearing segments along the longitudinal axis while allowing the bearing elements to rotate about the inner member.

In some forms of the invention, the plurality of cylindrical-shaped bearing elements may be secured to the outer member with a longitudinally extending key arrangement operatively engaging an outer surface of the bearing elements and an inner surface of the outer member. Where the bearing elements have a longitudinal length thereof a method, according to the invention, may include forming a longitudinally extending slot in an outer surface of the bearing elements, with the slot being configured for engaging the distal end of a longitudinally extending key element protruding into the annular space from a wall of the outer member, and having the distal end thereof configured for engaging the longitudinally extending slots in the bearing elements. The longitudinally extending slot in each one of the bearing elements may be aligned with the key element as each of the bearing elements enter the annular space.

In some forms of the invention, where the bearing elements have a longitudinal length thereof, a method may include forming the longitudinally extending key element from a plurality of distributed key elements. With such an arrangement, the plurality of distributed key elements may be affixed to the outer member in a longitudinally spaced array from one another along a line extending parallel to the longitudinal axis, with the individual key members spaced from one another by a distance of less than the longitudinal length of the bearing elements. The longitudinally extending slot in each one of the bearing elements may be aligned with the line of key elements as each of the bearing elements enters the annular space.

Other aspects, objects and advantages of the invention will be apparent from the following description and accompanying drawings of exemplary embodiments.

BRIEF DESCRIPTION OF THE DRAWINGS

The drawings of preferred embodiments illustrate several aspects of the present invention and, together with the written description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention.

DETAILED DESCRIPTION OF THE INVENTION

FIGS. 1-6 illustrate a first exemplary embodiment of a rotatable processing roll apparatus 100, according to the invention. Specifically, the first exemplary embodiment of the processing roll 100 takes the form of a first exemplary embodiment of a folding roll 100, of the type typically used in paper processing operations.

Figure 1:
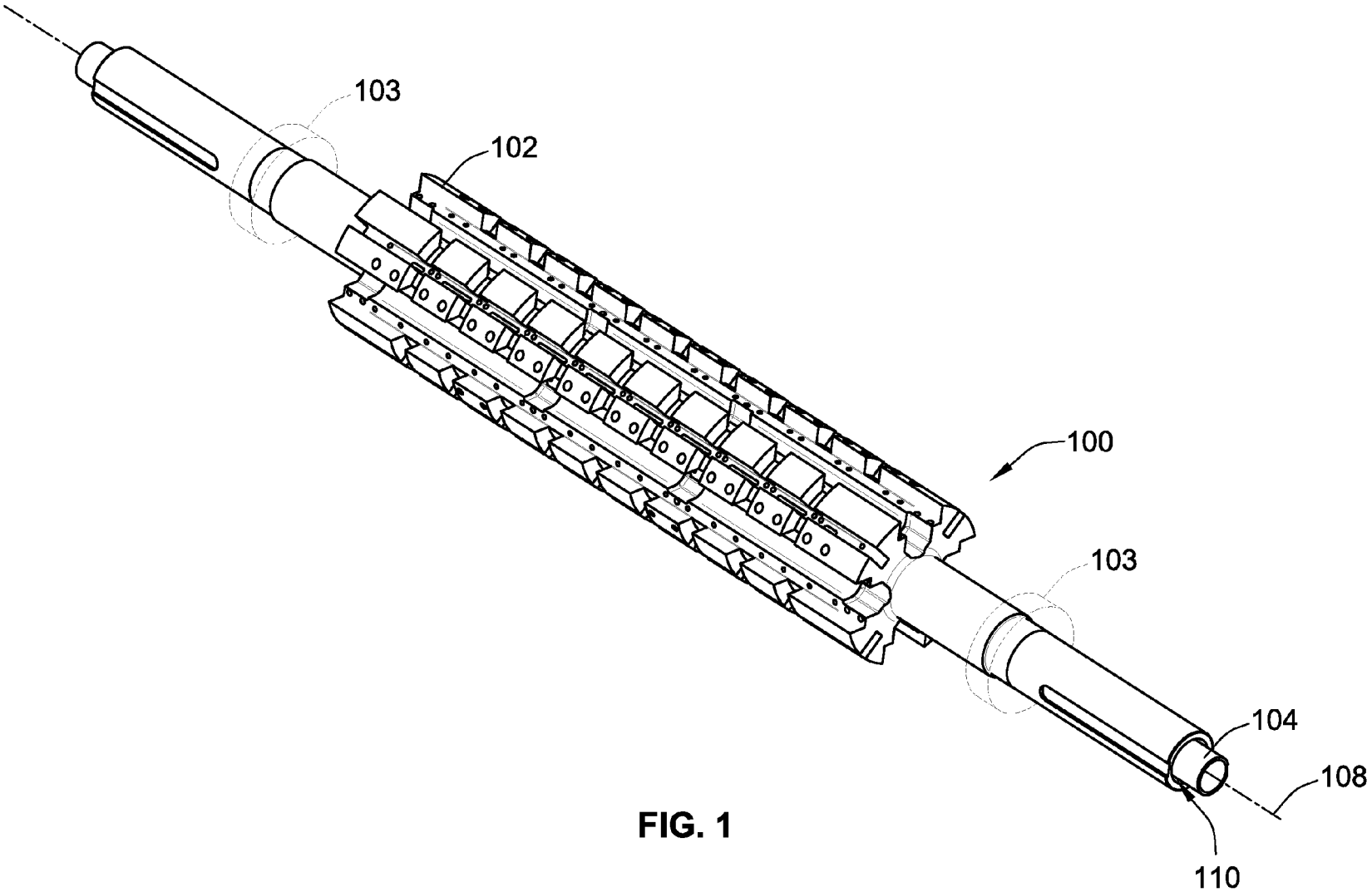
FIG. 1 is a perspective illustration of a first exemplary embodiment of a processing roll, according to the invention, in the form of a folding roll of the type used in the paper processing industry.
Figure 2:
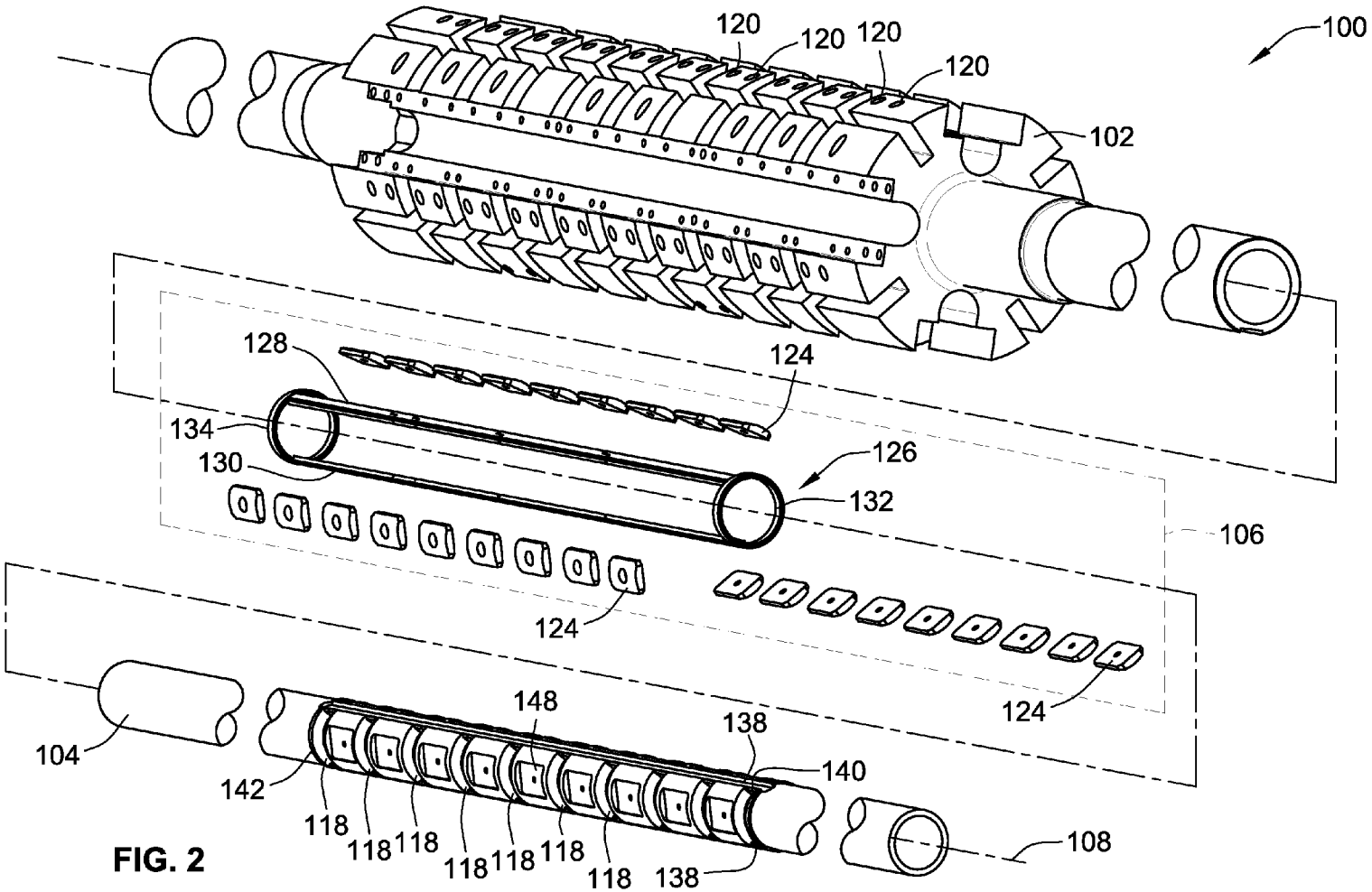
FIG. 2 is an exploded perspective illustration of the first exemplary embodiment of the invention of FIG. 1.

As shown in FIGS. 1 and 2, the folding roll 100 includes a rotatable outer tube 102 operatively supported by bearing arrangements 103 at opposite axial ends of the outer tube 102 for rotation about a non-rotatable inner tube 104. The inner tube 104 is supported within the outer tube 102 by a fluid valving arrangement 106 which provides distributed bearing support of the inner tube 104 in addition to providing regulated fluid communication between the outer and inner tubes 102, 104 in a manner described in more detail below.

As shown in FIGS. 1 and 2, the non-rotatable inner tube 104 extends along a longitudinal axis 108. The rotatable outer tube 102 is disposed about the inner tube 104 for rotation about the longitudinal axis 108. The inner and outer tubes 104, 102 define an elongated annular space 110 between the inner and outer tubes 104, 102, as illustrated in FIGS. 1 and 4A.

Figure 4:
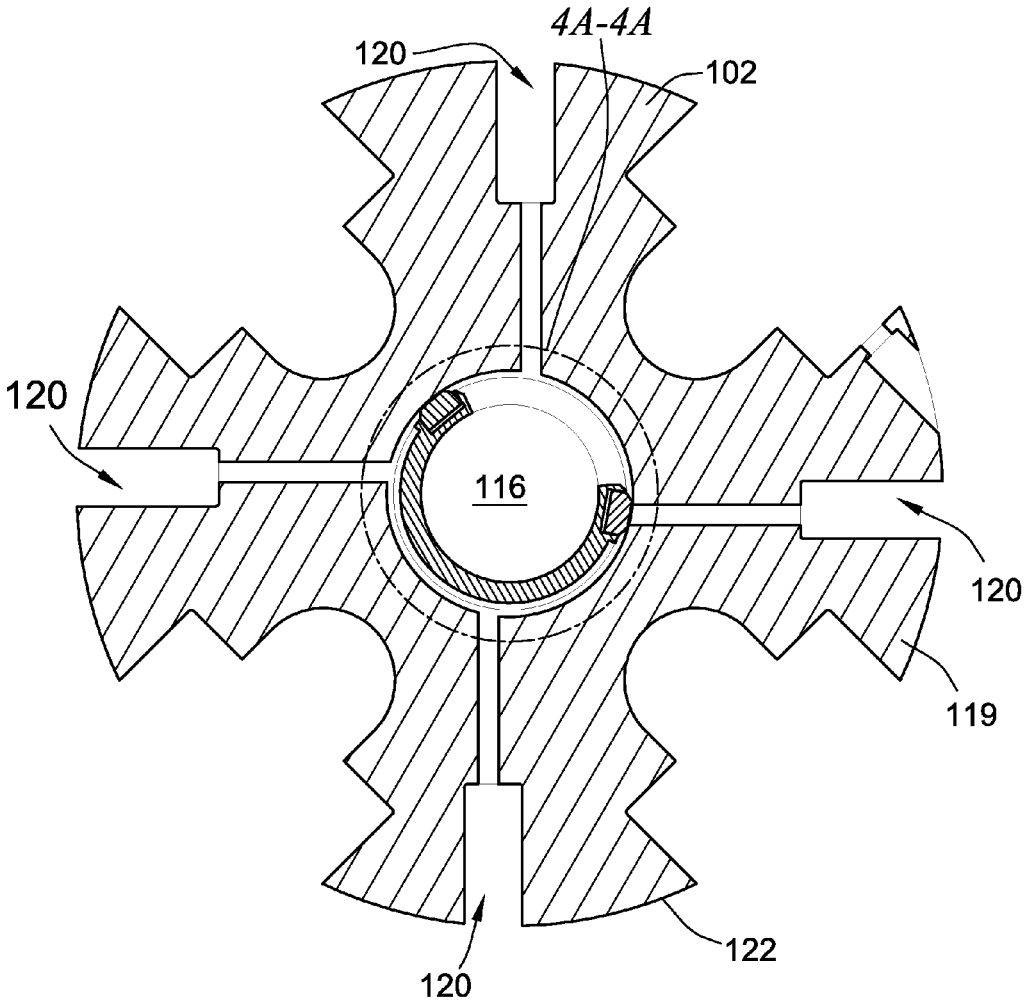
FIG. 4 is an enlarged cross-sectional illustration of a portion of the first exemplary embodiment of FIG. 1, with the section taken between the bearing elements shown in FIG. 3.
Figure 4A:
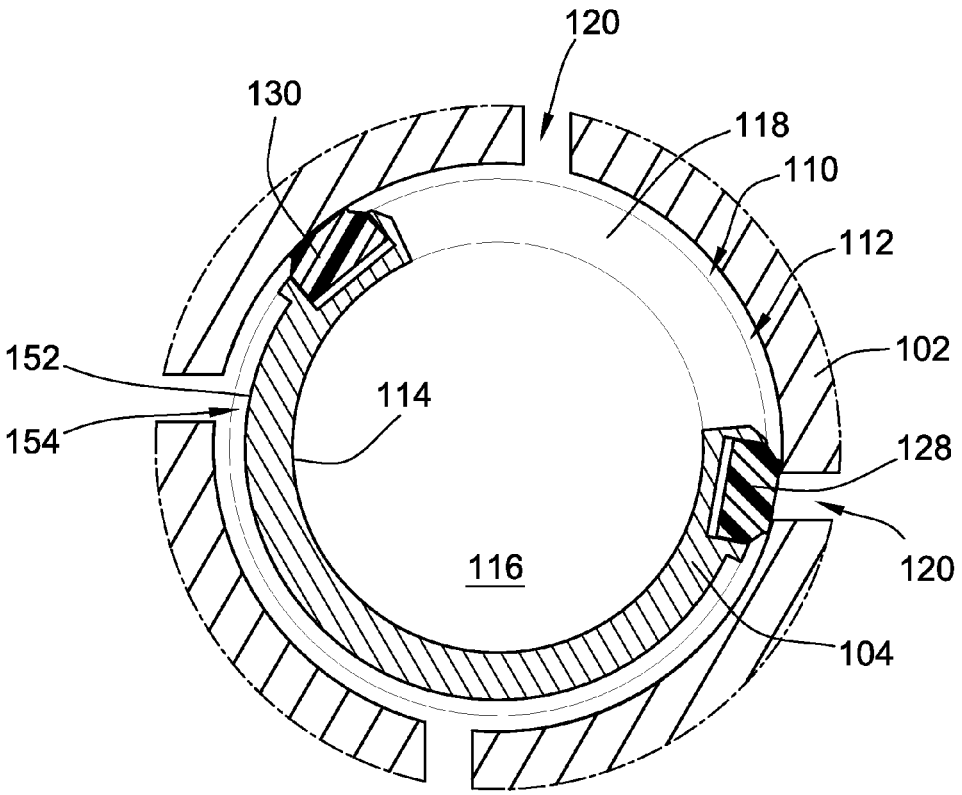
FIG. 4A is an enlarged cross-sectional view of a portion of the structure shown in FIG. 4, within an area enclosed by dashed line identified as "FIG. 4A" in FIG. 4.

As illustrated in FIG. 4A, and described in more detail below with reference to FIG. 5, the elongated inner space 110 space between the inner and outer tubes 104, 102 includes a longitudinally elongated vacuum transfer zone 112 located at a predetermined relative angular positioning of the outer tube 102 with respect to the inner tube 104. The fluid valving arrangement, in the form of a vacuum valving arrangement 106 in the first exemplary embodiment of the folding roll 100, is disposed in the elongated annular space 110 between the inner and outer tubes 104, 102, in a manner described in more detail below. The vacuum valving arrangement 106 includes elements described in more detail below which define the vacuum transfer zone 112 partly illustrated in FIG. 4A.

As shown in FIG. 4A, the inner tube 104 has a wall 114 with an inner surface of the wall 114 defining an elongated fluid plenum 116 extending along the longitudinal axis 108 beneath the elongated vacuum transfer zone 112. As shown in FIGS. 2 and 4A, the wall 114 of the inner tube 104 also defines a plurality of fluid ports, in the form of vacuum ports 118, which provide fluid communication between the vacuum transfer zone 112 and the vacuum plenum 116.

As shown in FIG. 4, the main body of the outer tube 102 defines a wall 119 of the outer tube 102 including a plurality of fluid ports, in the form of vacuum ports 120. As shown in FIG. 2, the vacuum ports 120 in the outer tube 102 are distributed along the longitudinal axis 108 of the outer tube 102. The vacuum ports 120 in the outer tube 102 open on an outer surface 122 of the outer tube 102, and extend through the wall 119 of the outer tube 102 to provide fluid communication between the vacuum ports 120 in the outer surface 122 of the outer tube 102 and the annular space 110 between the inner and outer tubes 104, 102.

Figure 5:
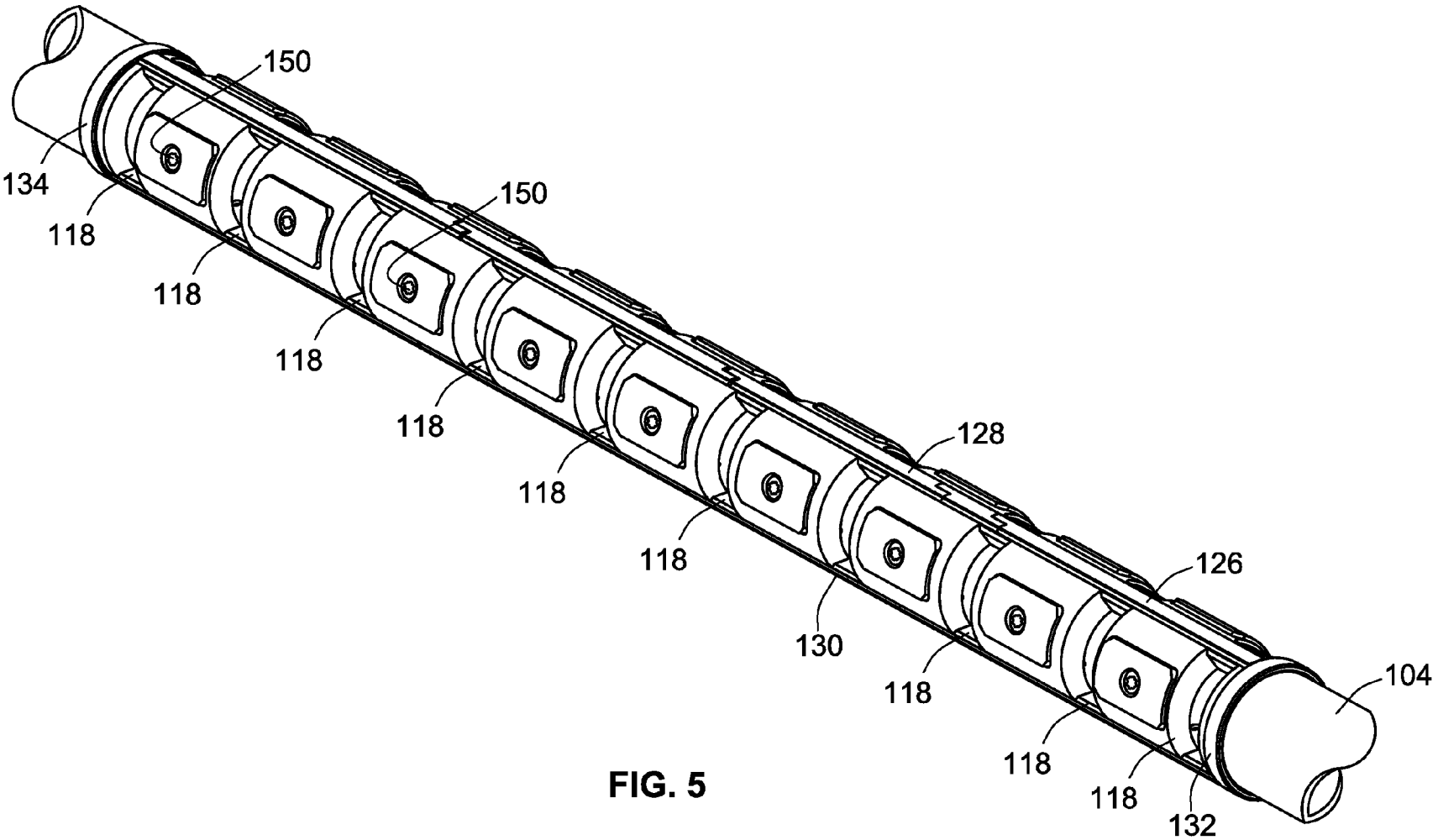
FIG. 5 is a perspective illustration of an inner tube of the first exemplary embodiment of the invention shown in FIGS. 1 and 2, with exploded components of FIG. 2 shown in their installed position on the inner tube in FIG. 5.

As indicated in FIG. 4A and FIG. 5, the vacuum ports 118 in the first exemplary embodiment of the folding roll apparatus 100 take the form of circumferentially extending slots 118 which are axially spaced from one another along the longitudinal axis 108 and aligned with one another to form a longitudinally extending array of the vacuum ports 118 in the inner tube 104. In other embodiments of the invention, other fluid port shapes and orientation may be utilized, however.

As shown in FIG. 2, the vacuum valving arrangement 106, in the first exemplary embodiment of the folding roll 100, includes a bearing arrangement in the form of a plurality of bearing elements 124, only two of which are numbered in FIG. 2, and a seal arrangement 126 having first and second longitudinally extending seal elements 128, 130 connected at opposite axial ends thereof by first and second circumferentially extending seal elements 132, 134. As shown in FIG. 2, the first and second longitudinally extending seal elements 128, 130 are contained respectively in longitudinally extending channels 136 and 138 in the outer surface of the wall 114 of the inner tube 102. As further illustrated in FIG. 2, the first and second circumferentially extending seal elements 132, 134 are secured in circumferentially extending grooves 140, 142 in the outer surface of the wall 114 of the inner tube 104.

As will be understood from FIGS. 4, 5 and FIG. 2, the seal arrangement 126, in the first exemplary embodiment of the folding roll 100, defines the periphery of the vacuum transfer zone 112. As further illustrated in FIGS. 4 and 5, the row of longitudinally spaced, circumferentially extending vacuum ports 118 in the inner tube 104 of the first exemplary embodiment of the folding roll 100 are all disposed within the vacuum transfer zone 112 as defined by the seal arrangement 126.

Figure 6:
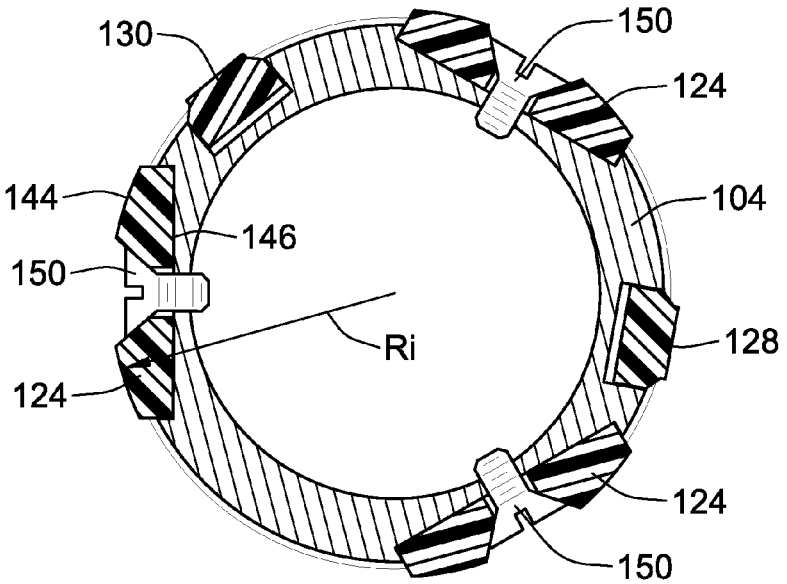
FIG. 6 is an enlarged view of an area of the cross-sectional view of FIG. 3, an area enclosed by dashed line identified as "FIG. 6" in FIG. 3.

As shown in FIG. 6, the radially outer surface 144 of each of the bearing elements 124 has a curved, arcuate shape substantially matching the radius Ri of an inner surface of the wall 119 of the outer tube. The opposite, radially inner surface 146 of each of the bearing elements 124 is flat and configured for attachment within a respective flat-bottomed bearing element recess 148 in the inner tube 104, and to be secured therein by a screw 150 in the manner indicated in FIGS. 2, 3 and 5.

Figure 3:
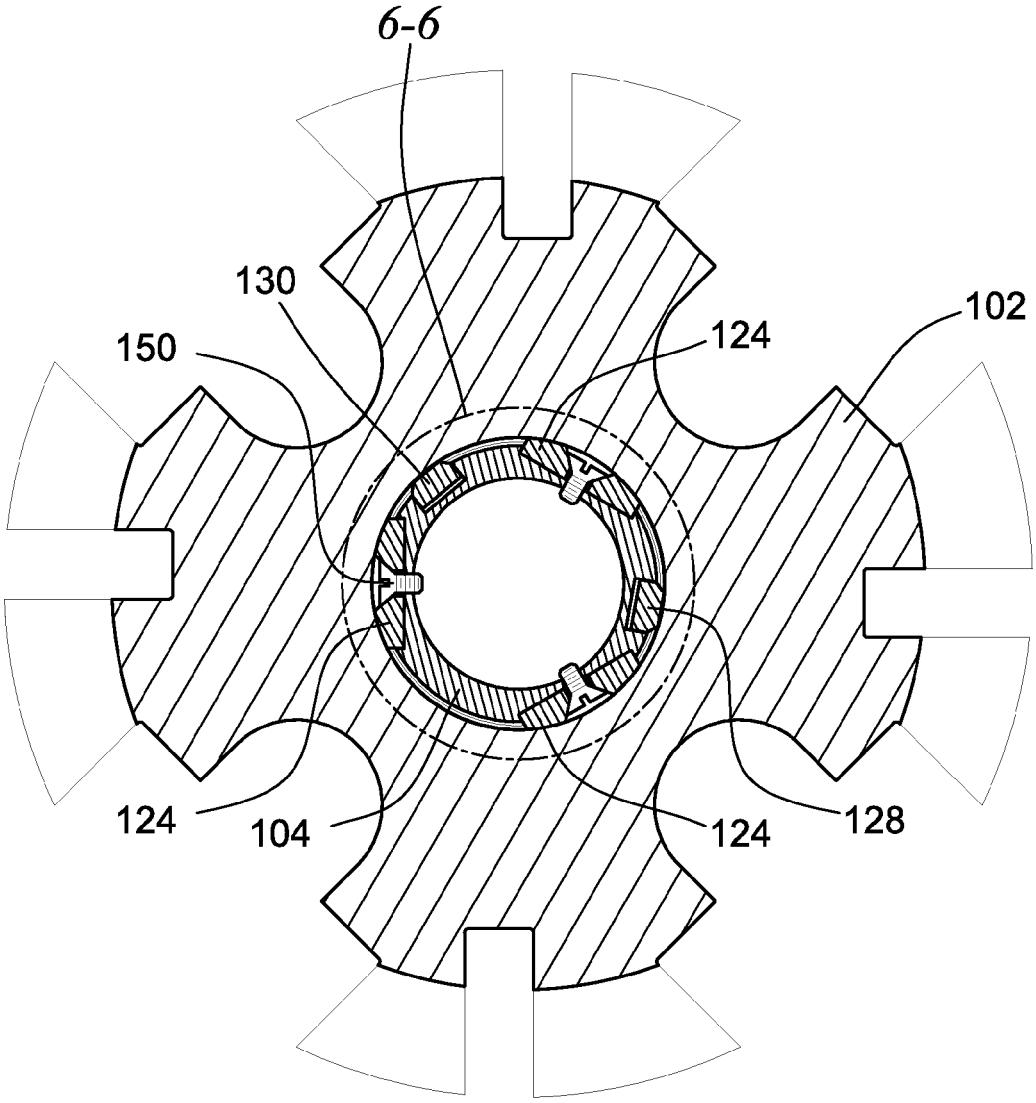
FIG. 3 is an enlarged cross-sectional illustration of a portion of the first exemplary embodiment of FIG. 1, with the section being taken through a plurality of bearing elements of the first exemplary embodiment.

As indicated in FIGS. 2, 3 and 5, the bearing element recesses 148 in the first exemplary embodiment of the folding roll 100 are disposed in three equally angularly spaced rows, with respect to one another about the periphery of the inner tube 104, to thereby provide 360° support of the outer tube 102 on the inner tube 104. As further illustrated in FIGS. 2 and 5, the bearing elements 124 of one of the three rows of bearing elements 124 are respectively disposed between pairs of adjacent circumferentially extending vacuum ports 118 within the vacuum transfer zone 112.

By virtue of the above-described arrangement of components, it will be understood that the vacuum valving arrangement 106 of the first exemplary embodiment of the folding roll 100 provides angularly controlled transfer of vacuum from the vacuum plenum 116 inside of the inner tube 102 to the vacuum ports 120 distributed longitudinally along the outer surface 122 of the outer tube, whenever one of the vacuum ports 120 in the outer tube is in fluid communication with the vacuum transfer zone 112, in the manner illustrated in FIG. 4. When a respective one, or an aligned array of the vacuum ports 120 in the outer tube are rotated away from alignment with the vacuum transfer zone 112, the vacuum valving arrangement 106 cuts off vacuum to that particular one of the vacuum ports or the array of vacuum ports 120 in the outer roll 102.

As shown in FIG. 4A, a portion of the outer surface of the wall 114 of the inner tube 104, in the first exemplary embodiment of the folding roll 100, is recessed opposite the circumferentially extending vacuum ports 118 in the inner tube 104, to provide an atmospheric pressure zone 154, whenever the recessed section 152 of the wall 119 is angularly aligned with one or more of the vacuum ports 120 in the outer tube.

It will also be understood, from the preceding description, that the bearing elements 124 of the vacuum valving arrangement 106 in the first exemplary embodiment of the folding roll 100 provide sole bearing support in a distributed manner of the inner tube 104 on the outer tube 102 at a plurality of locations along the longitudinally extending axis 108 and the elongated vacuum transfer zone 112. Those having skill in the art will recognize that the longitudinally distributed bearing support arrangement of the present invention eliminates the need for the bearing arrangements at opposite axial ends of the inner tube 104, which would have been required prior to the invention, and also provides a structurally enhanced overall structure in the folding roll 100, as compared to prior approaches.

It will be further understood, that because the vacuum plenum 116 of the present invention is substantially larger in volume than the individual longitudinally extending bores utilized in prior roll arrangements having fluid, and particularly vacuum ports extending longitudinally into the roll to connect vacuum ports on the surface of the roll with a fluid control arrangement mounted at an axial end of one of the prior rolls, the present invention significantly improves the rate at which vacuum from the plenum 116 is communicated to the vacuum ports 120 at the outer periphery of the outer roll.

In prior approaches using vacuum control arrangements disposed at one or the other axial ends of a roll, it was necessary that a vacuum be pulled along the entire length of a fluid passage extending from the vacuum port in the outer surface of the roll, along the longitudinally extending portion of the passage connecting the respective vacuum port to the end of the roll, and then in an internal passageway of the vacuum valve. With the present invention, full vacuum is present at all times along the entire longitudinal length of the roll 100. When a respective vacuum port 120 comes into angular alignment with the vacuum transfer zone 112, vacuum needs be established over only a very short distance through the wall 119 of the outer tube 102. Also, because full vacuum is present along the entire longitudinal length of the vacuum plenum 116, uniform vacuum will be provided at all vacuum ports 120 of the outer tube 102 which are simultaneously in fluid communication with the vacuum transfer zone 112. This provides substantially enhanced performance over prior arrangements wherein it was not possible to quickly establish uniform vacuum at vacuum ports located at different longitudinal distances from the axial end of the roll connected to the vacuum source. There is, accordingly, much less time lag in operation of the present invention, as compared to prior approaches.

From the above description, it will be apparent to those having skill in the art that the present invention includes a number of structural and functional improvements over prior rotating process rolls which allow a rotating process roll apparatus or method in accordance with the present invention to operate at higher rotational speeds, and/or to have a longer length than was attainable with prior approaches.

FIGS. 7-14 illustrate a second exemplary embodiment of a rotatable processing roll apparatus 200, according to the invention. Specifically, the second exemplary embodiment of the processing roll 200 takes the form of a folding roll 200, of the type typically used in paper processing operations.

Figure 7:
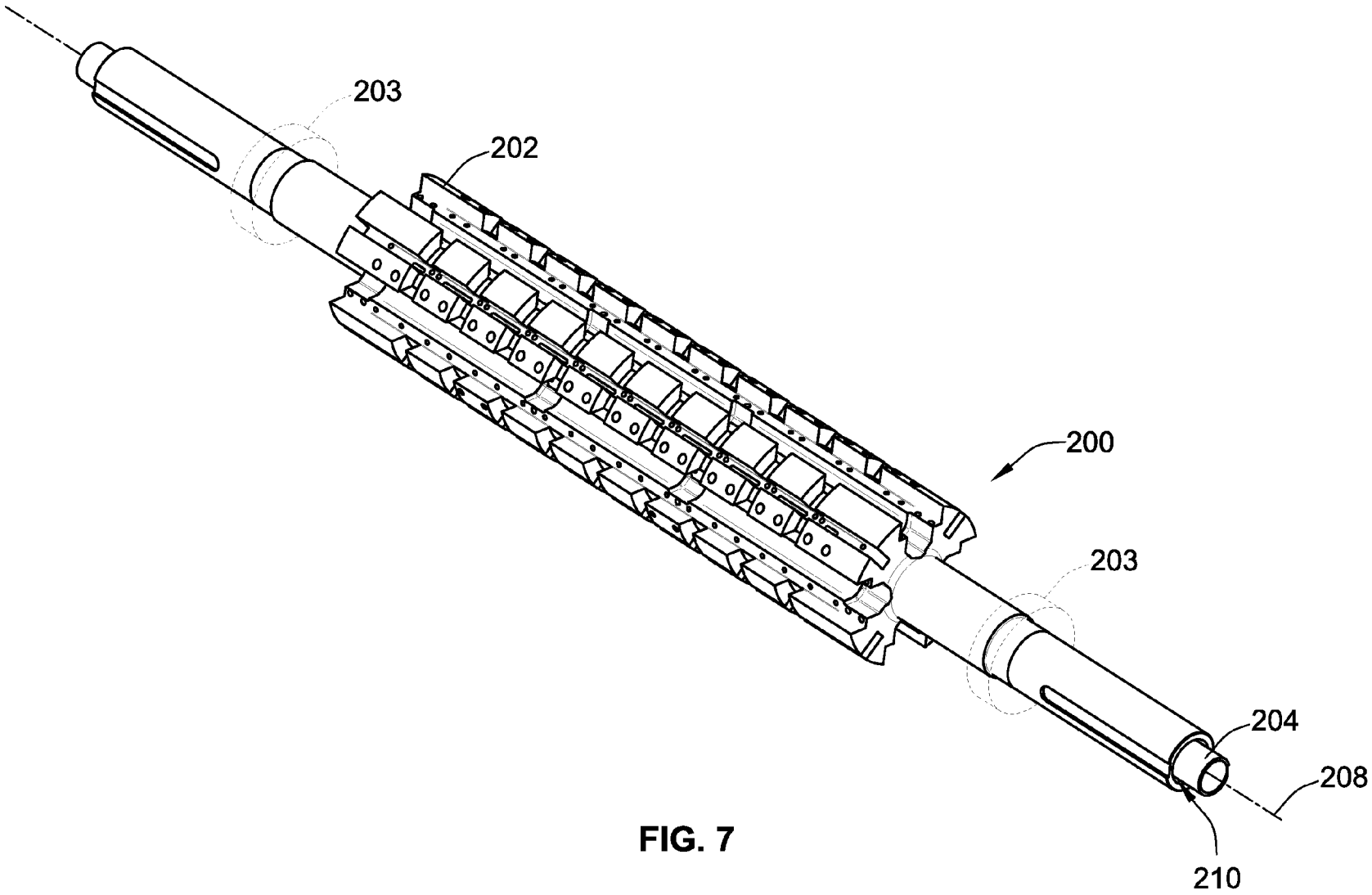
FIG. 7 is a perspective illustration of a second exemplary embodiment of a processing roll, according to the invention, in the form of a folding roll of the type used the paper processing industry.
Figure 8:
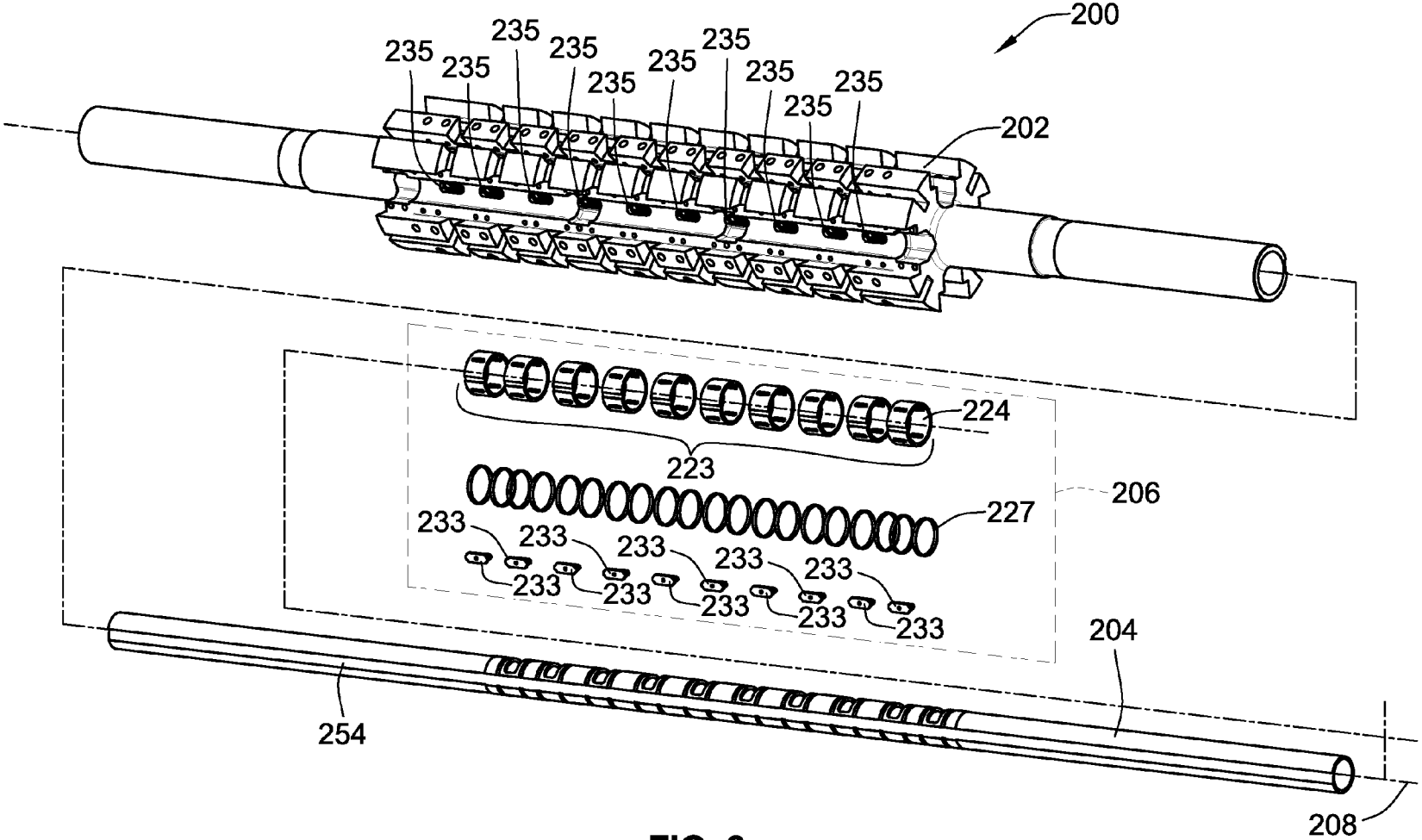
FIG. 8 is an exploded perspective illustration of the second exemplary embodiment of the invention shown in FIG. 7.

As shown in FIGS. 7 and 8, the folding roll 200 includes a rotatable outer tube 202 operatively supported for rotation about a non-rotatable inner tube 204 by bearing arrangements 203 disposed at opposite axial ends of the folding roll 200. The inner tube 204 is supported within the outer tube 202 by a fluid valving arrangement 206 which provides distributed bearing support of the inner tube 204 in addition to providing regulated fluid communication between the outer and inner tubes 202, 204 in a manner described in more detail below.

As will be understood from the following description of the various components of the second exemplary embodiment of the folding roll 200, the second exemplary embodiment of the folding roll 200 is functionally and physically interchangeable with the first exemplary embodiment of the folding roll 100 described herein above.

The fluid valving arrangement 206 and the second exemplary embodiment of the folding roll apparatus 200 differs in a number of respects from the fluid valving arrangement 106 used in the first exemplary embodiment of the folding roll apparatus 100, however. Simply stated, a primary difference between the valving arrangements 106, 206 in the first and second exemplary embodiments 100, 200 derives from attachment of a plurality of bearing elements 224 in the second exemplary embodiment of the folding roll 200 to the outer tube 202, whereas the bearing elements 124 were attached to the inner tube 104 of the first exemplary embodiment of the folding apparatus 100. Also, the bearing elements 224 also function as seal elements, thereby eliminating the need for separate longitudinal and circumferential seal elements 128, 130, 132, 134 of the type described above in reference to the first exemplary embodiment of the folding roll apparatus 100.

As shown in FIGS. 7 and 8, the non-rotatable inner tube 204, of the second exemplary embodiment of the folding roll apparatus 200, extends along a longitudinal axis 208 of the roll 200. The rotatable outer tube 202 is disposed about the inner tube 204 for rotation about the longitudinal axis 208. The inner and outer tubes 204, 202 define an elongated annular space 210 between the inner and outer tubes 204, 202 as illustrated in FIGS. 7 and 9.

As illustrated in FIGS. 8-12, in the second exemplary embodiment of the folding roll 200, the bearing elements 224 have a cylindrical shape and function as cylindrical-shaped bearing/seal elements 224. The cylindrical-shaped bearing/seal elements 224 each include a plurality of vacuum ports 225 therein, which in combination with one another serve to define a longitudinally interrupted elongated vacuum transfer zone 212 located at a predetermined relative angular position of the outer tube 202 with respect to the inner tube 204. The fluid valving arrangement 206, in the form of a vacuum valving arrangement 206 in the second exemplary embodiment of the folding roll 200 is disposed in the elongated annular space 210 between the inner and outer tubes 204, 102, in manner described in more detail below. The vacuum ports 225 in the plurality of bearing/seal elements 224 of the vacuum valving arrangement 206, in combination with one another and the vacuum ports 218 in the inner tube 204, define a longitudinally interrupted vacuum transfer zone 212 extending longitudinally along the row of bearing/seal elements 224 over the angularly extending vacuum ports 218 in the inner tube 204.

Figure 9:
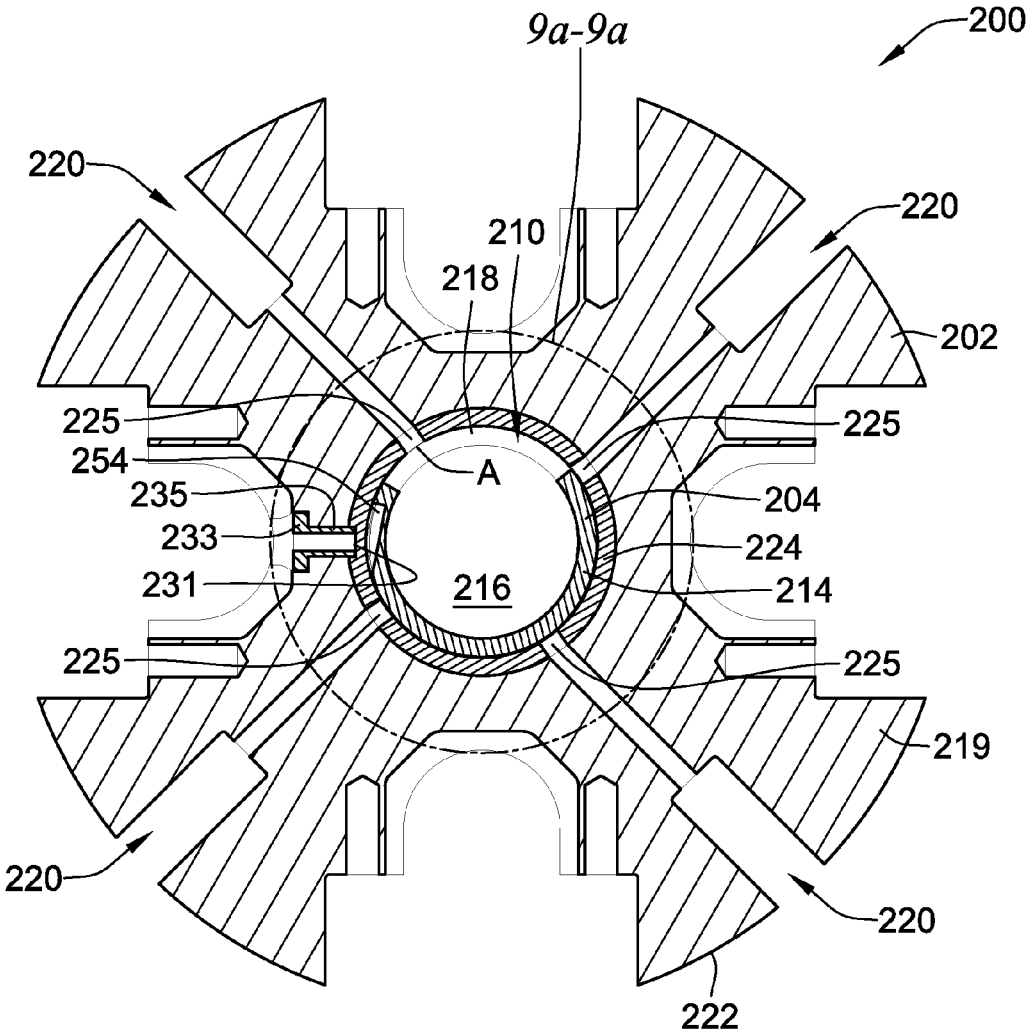
FIG. 9 is an enlarged cross-sectional illustration of a portion of the second exemplary embodiment of the invention shown in FIGS. 7 and 8.
Figure 9A:
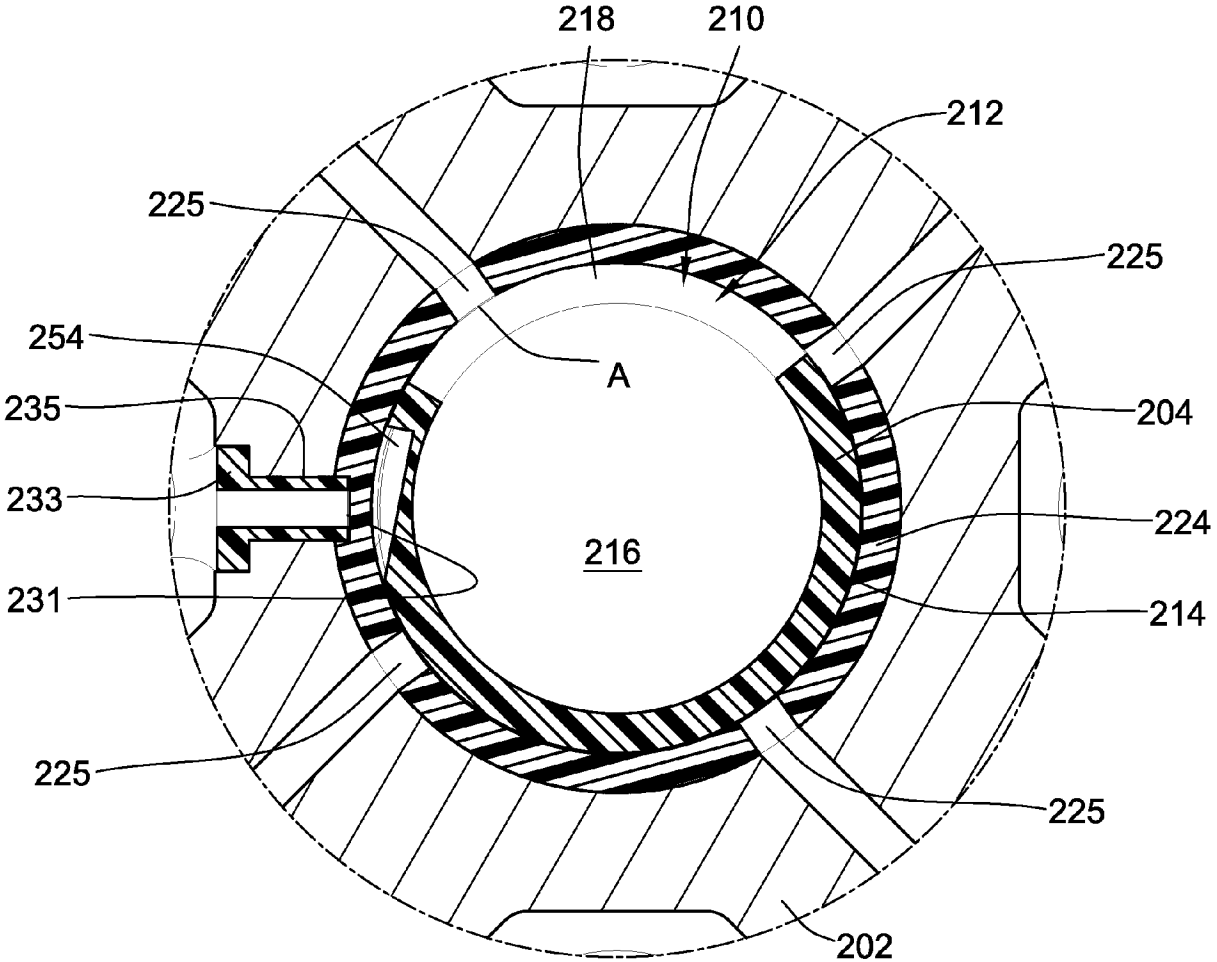
FIG. 9A is an enlarged cross-sectional view of a portion of FIG. 9, within an area indicated by the dashed line marked "FIG. 9A" in FIG. 9, illustrating structural and functional details of components within the second exemplary embodiment of the invention of FIGS. 1 and 2.
Figure 11:
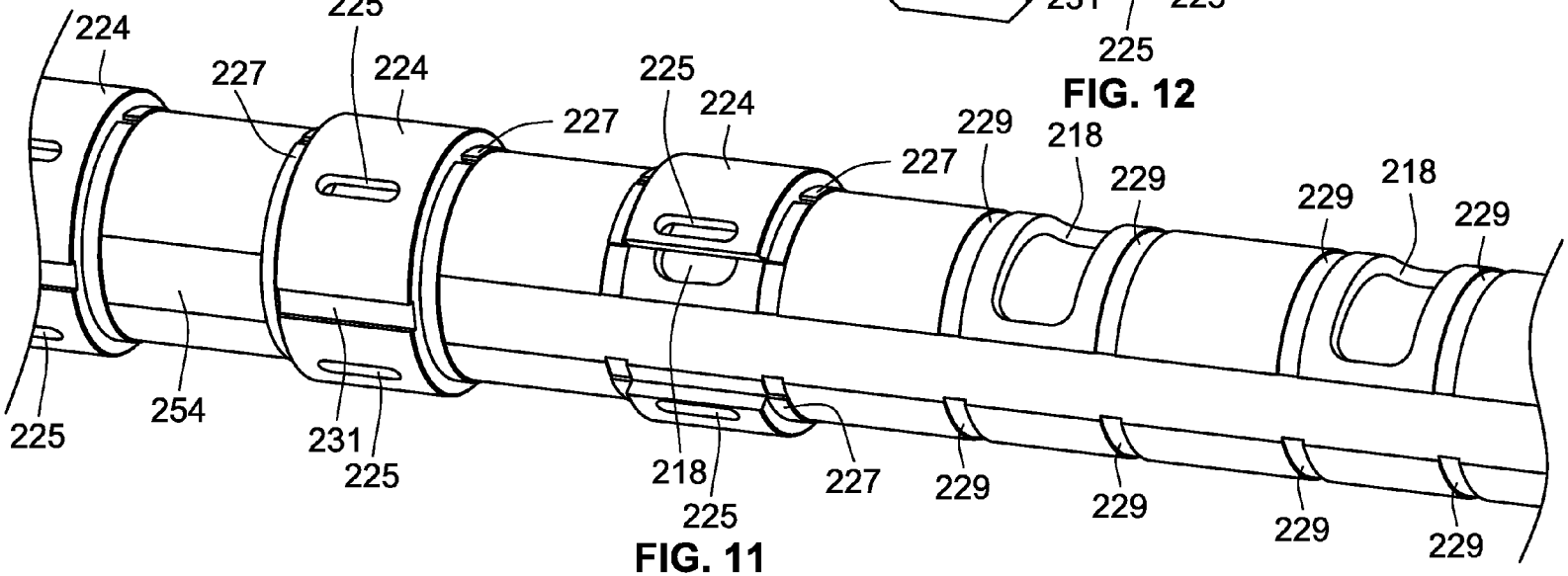

As shown in FIG. 9, the inner tube 204 has a wall 214 with an inner surface of the wall 214 defining an elongated fluid plenum 216 extending along the longitudinal axis 208 beneath the elongated interrupted vacuum transfer zone 212. As shown in FIGS. 9, 9A and 11, the wall 214 of the inner tube 204 also defines a plurality of fluid ports, in the form of vacuum ports 218, which provide fluid communication between the vacuum transfer zone 212 and the vacuum plenum 216. As indicated in FIG. 11, the vacuum ports 218 in the second exemplary embodiment of the folding roll apparatus 200 take the form of circumferentially extending slots which are axially spaced from one another along the longitudinal axis 208 and aligned with one another to form a longitudinally extending array of the vacuum ports 218 in the inner tube 204.

Figure 10:
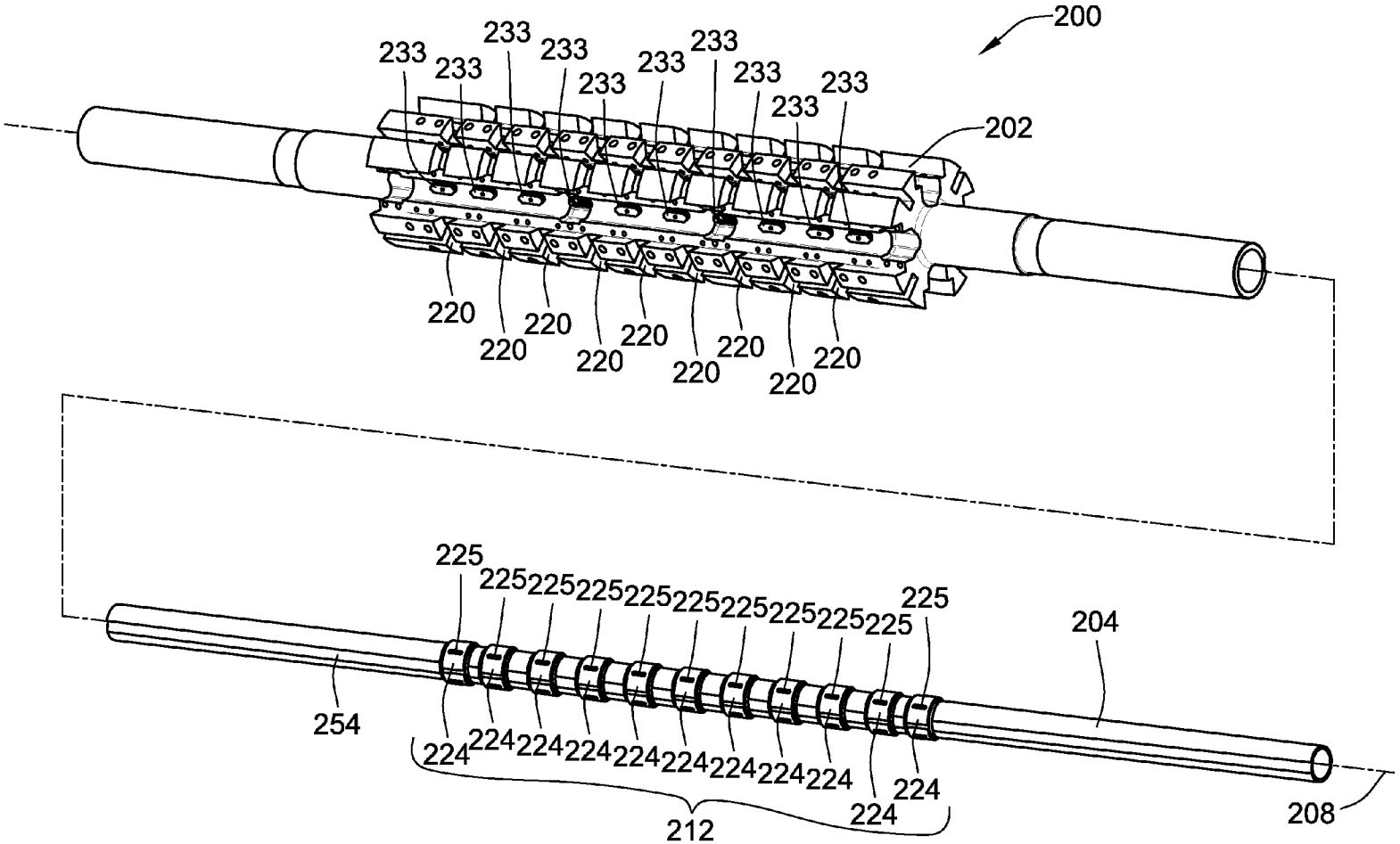
FIG. 10 is a partly exploded perspective illustration showing the manner in which the second exemplary embodiment of the invention of FIG. 1 may be assembled from the components shown in the fully exploded view of FIG. 8.

As shown in FIG. 9, the main body of the outer tube 202 defines a wall 219 of the outer tube 202 which includes a plurality of fluid ports, in the form of vacuum ports 220 in the outer tube 202. As indicated in FIG. 10, the vacuum ports 220 in the outer tube 202 are distributed along the longitudinal axis 208 of the outer tube 202. The vacuum ports 220 in the outer tube 202 open on an outer surface 222 of the outer tube 202, and extend through the wall 219 of the outer tube 202 to provide fluid communication between the vacuum ports 220 and the outer surface 222 of the outer roll 202 and the annular space 210 between the inner and outer tubes 204, 202.

As shown in FIG. 8, the vacuum valving arrangement 206 in the second exemplary embodiment of the folding roll apparatus 200, includes a bearing arrangement 223 including a plurality of the cylindrical-shaped bearing/seal elements 224, only one of which is numbered in FIG. 8.

Figure 12:
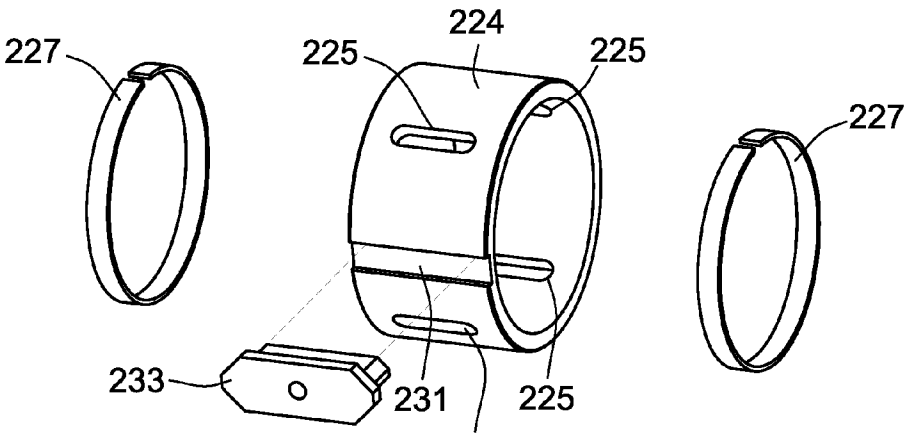
FIGS. 11-14 are enlarged close-up perspective illustrations showing the construction and installation details of a number of the components of the second exemplary embodiment of the invention shown in FIGS. 7 and 8.
Figure 14:
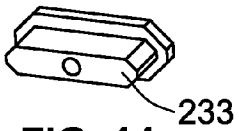
Figure 13:
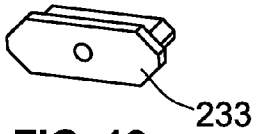

As shown in FIGS. 11 and 12, each of the cylindrical-shaped bearing/seal elements 224 is secured axially over a corresponding one of the vacuum ports 218 in the inner tube 204 by a pair of snap ring arrangements 227 hereinafter referenced as "snap rings 227" which engage grooves 229 in the outer surface of the inner tube 204 and bear against opposite axially ends of the cylindrical-shaped bearing/seal elements 224, to thereby axially retain the cylindrical-shaped bearing/seal elements at a desired location along the longitudinal axis 208. With this arrangement, the cylindrical-shaped bearing/seal elements 224 each overlap a corresponding one of the vacuum ports 218 in the inner tube 204, in such a manner that the vacuum ports 225 and the cylindrical-shaped bearing/seal elements 224 are axially aligned over their corresponding vacuum port 218 in the inner tube 204. The cylindrical-shaped bearing/seal elements are configured and retained in such a manner that the cylindrical-shaped bearing/seal elements 224 are rotatable about the inner tube 204. Although each of the snap ring arrangements 227 in the exemplary embodiment 200 has only one part, in other embodiments of the invention, snap rings having multiple parts, or other means of axially securing the bearing/seal elements 224 may be used.

As shown in FIG. 12, each of the cylindrical-shaped bearing/seal elements 224 includes a longitudinally extending groove 231 in an outer surface thereof for receipt of the distal end of a respective one of a series of keys 233, in the manner illustrated in FIG. 9.

As will be understood from FIGS. 8 and 9, the outer tube 202 includes a series of key holes 235 extending through the wall 219 of the outer tube 202 for receipt of the keys 233. The key holes 235 are arranged in an axially spaced relationship to one another, at an axial spacing from one another less than the longitudinal length of the bearing/seal elements 224, in a longitudinally extending row along the longitudinally axis 208, each of the plurality key holes 235 being substantially axially aligned with a respective one of the bearing/seal elements 224 when the folding roll apparatus 200 is assembled. The key holes 235 and the keys 233 are cooperatively configured, in the exemplary embodiment, in such a manner that the distal ends of the individual keys 233 extend into the annular space 210 between the inner and outer tubes 204, 202, when the keys 233 are inserted into the key holes 235. In the exemplary embodiment, the keys 233 are retained in the key holes 235 by a press fit, but in other embodiments of the invention the keys may be retained in any appropriate manner.

The distal ends of the keys 233 and the longitudinally extending slots 231 in the outer surfaces of the cylindrical-shaped bearing/seal elements 224 are cooperatively configured so that the distal ends of the keys 233 will slide through the slots 231 in the cylindrical members in an axial direction during assembly of the folding roll 200. The distal ends of the keys 233 and the slots 231 in the cylindrical-shaped bearing/seal members are further configured such that once the inner tube with the cylindrical-shaped bearing/seal elements axially secured thereupon the snap rings 227 is inserted into the outer tube 202, the distal ends of the keys 233 engaging the slots 231 in each of their respective cylindrical-shaped bearing/seal elements will secure the bearing/seal elements 224 to the outer tube 202 for rotation therewith.

The cylindrical-shaped bearing/seal elements 224 are further configured in such a manner that, once the bearing/seal element is rotationally secured to the outer tube 202 by the distal end of the key 233, the vacuum ports 225 in the bearing/seal member will be fixed in alignment with a respective one of the vacuum ports 220 in the outer tube 202. The inner and outer surfaces of the bearing/seal elements 224 are further configured to provide a fluid seal between the inner and outer tubes 204, 202.

As will be understood from FIG. 9, when one of the vacuum ports 225 in any of the bearing/seal elements 224 is aligned with the circumferentially extending slot-shaped vacuum port 218 in the inner tube 204, one of the vacuum ports 220 on the outer surface 222 of the outer roll 202 will be connected via the vacuum port 220 in the outer tube, the vacuum port 225 in the bearing/seal member 224 and the vacuum port 218 in the inner tube with the vacuum plenum 216 inside of the inner tube 204.

As illustrated in FIGS. 8, 9, 9A and 11, a portion of the outer surface of the inner tube 204, in the second exemplary embodiment of the folding roll 200, is machined away to provide an atmospheric transfer zone 224. By virtue of the arrangement described above it will be understood as the outer tube 202 rotates about the inner tube 204, the respective ports 220 and the outer surface 222 of the outer tube 202 will be sequentially connected and disconnected from the vacuum plenum 216 and the atmospheric transfer zone 254.

It will be appreciated, by those having skill in the art, that the construction of the second exemplary embodiment described here and above provides an elegantly simple and novel approach to providing a plurality of distributive bearing/seal elements disposed in a spaced relationship from one another along the axis of the outer rotating tube 202, and attached to the rotating outer tube 202 for rotation with the outer tube 202. The distal ends of the individual keys 233 essentially form an interrupted key extending from the inner wall of the bore in the outer tube 202. As the inner tube 202 with the cylindrically-shaped bearing/seal elements 224 secured axially thereupon by the snap rings 227 is fed into the bore and the outer tube, each of the individual cylindrical-shaped bearing/seal elements can be rotated to place its respective groove 231 in alignment with the first key 233, and with all other keys in the exemplary embodiments since they are angularly aligned with one another, in such a manner that the inner tube 202 can be fed into the bore in the inner tube 204. It will be recognized that, in other embodiments of the invention, a single key, or other methods may be utilized for securing the bearing/seal elements 224 to the outer tube 202.

As previously stated, the first and second exemplary embodiments of folding roll apparatus 100, 200 described herein are essentially interchangeable once fully assembled. Both embodiments have been shown to function well in operation. The second exemplary embodiment provides an advantage in that, because the bearing elements 224 are angularly affixed to the outer roll 202 and rotate therewith, all wear occurring during the operation of the folding roll 200 will occur between the inner periphery of the cylindrical-shaped bearing/seal elements 224 and an outer surface of the inner tube 204. Refurbishment of the second exemplary embodiment of the folding roll 200, after extended operation, is thus anticipated to be more straight forward, in that it will not be necessary to refinish the inner surface of the bore in the outer tube 202.

In the first and second exemplary embodiments of folding rolls 100 and 200 described above, the vacuum valving arrangements 106, 206 provide distributed bearing support to the inner tubes 104, 204 on the outer tubes 102, 202. It will be appreciated that with the longitudinally distributed bearing support provided in the first two exemplary embodiments of the folding rolls 100, 200, the inner tubes 104, 204 can have relatively thin outer walls of the tubes 104, 204, while still providing a large plenum area 116 in the interior of the inner tubes 104, 204

In some embodiments of the invention, however, it may be advantageous to support an outer tube on an inner tube of a processing roll arrangement, rather than having the inner tubes 104, 204 supported on the outer tubes 102, 202 as is the case in the first two exemplary embodiments of the folding rolls 100, 200.

Figure 15:
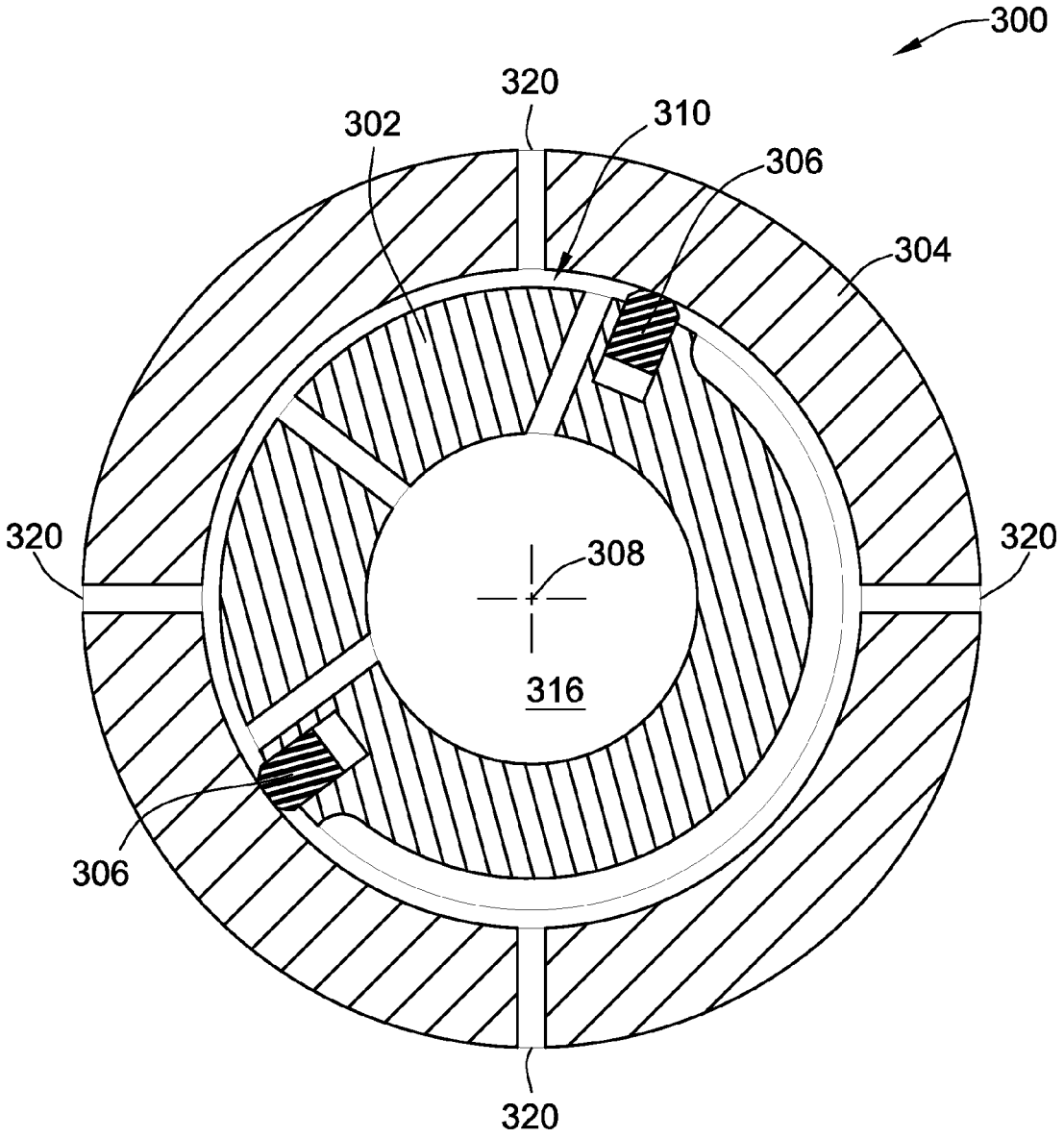
FIG. 15 is a cross-sectional illustration of a third exemplary embodiment of the invention in the form of a processing roll having an outer tube supported on an inner tube by a distributed vacuum valving arrangement according to the invention.

FIG. 15 shows a third exemplary embodiment of the invention in the form of a processing roll 300, in which an outer tube 304 is supported for rotation about a longitudinal axis 308 by a vacuum valving arrangement 306 disposed in an elongated annular space 310 between the inner and outer tubes 304, 302. It is contemplated that the vacuum valving arrangement 306 in the third exemplary embodiment of the folding roll 300 may take a form similar to either of the vacuum valving arrangements 106, 206 described above or any other appropriate form within the scope of the invention.

The processing roll of the third exemplary embodiment of the invention utilizes vacuum ports 220 on an outer surface of the outer tube 302 for controlling contact of a material being acted upon by the processing roll 300, and does not include provisions for mechanical grippers which caused the outer rolls tubes, 206 of the first two exemplary embodiments of folding rolls 100, 200 to have relatively thick walls, and resulting in a need for the inner tubes 104, 204 of the first exemplary embodiments of folding rolls 100, 200 to have a relatively small outer diameter.

In the third exemplary embodiment of the folding roll 300, the outer tube 302 can have a relatively thin wall, allowing the inner tube 304 to be relatively much larger in outside diameter and wall thickness, while still providing a substantial internal vacuum plenum 316. In such a configuration, therefore, the inner tube 304 may be more suitable and/or desirable for providing distributed bearing support to the outer tube 302 than vice versa.

For some embodiments of the invention having the outer tube supported on the inner tube by a distributed bearing arrangement in the form of a vacuum valving arrangement according to the invention, it is contemplated that such embodiments may also include additional bearing arrangements disposed at the axial ends of the outer tube.

It is specifically noted that, the terms "vacuum" and "fluid" as used herein with reference to embodiments of the invention are not intended to be limiting, and should be considered to be generally interchangeable. It is contemplated, for example, that in some embodiments of the invention pressurized air or other fluids may be supplied to the "vacuum plenum" inside of the inner tube, with the "vacuum valving arrangement" being used to regulate flow of the pressurized air or other fluid to ports in the outer tube.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A folding roll apparatus comprising:

a non-rotatable inner tube extending along a longitudinal axis and a rotatable outer tube disposed about the inner tube for rotation about the longitudinal axis with the inner and outer tubes defining an elongated annular space between the inner and outer tubes including a longitudinally elongated vacuum transfer zone at a predetermined relative angular positioning of the outer tube with respect to the inner tube; and a vacuum valving arrangement disposed in the elongated annular space between the inner and outer tubes;

the inner tube defining an elongated vacuum plenum therewithin extending along the longitudinal axis beneath the elongated vacuum transfer zone, with the inner tube having at least one vacuum port disposed therein providing fluid communication between the vacuum transfer zone and the vacuum plenum;

the outer tube including a plurality of vacuum ports distributed along the longitudinal axis on an outer surface of the outer tube and connected in fluid communication with the annular space between the inner and outer tubes;

the vacuum valving arrangement being configured for providing angularly controlled transfer of vacuum from the vacuum plenum inside of the inner tube to the vacuum ports distributed longitudinally along the outer surface of the outer tube, and also being configured for providing distributed bearing support of one of the outer tube and the inner tube on the other of the outer tube and the inner tube at a plurality of locations along the longitudinally elongated vacuum transfer zone.

2. The apparatus of claim 1, wherein, the vacuum valving arrangement provides the sole bearing support for the one of the outer tube and the inner tube.

3. The apparatus of claim 1, wherein, the vacuum valving arrangement is fixedly mounted on the inner tube and does not rotate.

4. The apparatus of claim 1, wherein, the vacuum valving arrangement is fixedly mounted within, and to, and rotates with the outer tube.

5. The apparatus of claim 1, wherein:

the non-rotatable inner tube has a wall of the inner tube defining the elongated vacuum plenum within the inner tube and a plurality of vacuum ports extending through the wall of the inner tube at a plurality of locations in the vacuum transfer zone along the longitudinal axis;

the rotatable outer tube has a wall of the outer tube extending along the longitudinal axis and defining the plurality of vacuum ports extending through the outer tube wall at a plurality of locations along the longitudinal axis;

the vacuum valving arrangement comprises a bearing arrangement having plurality of bearing elements disposed along the vacuum transfer zone and angularly affixed to one of the inner and outer tubes providing operative bearing contact between the walls of the inner and outer tubes for journaling the one of the outer tube and the inner tube on the other of the outer tube and the inner tube; and the vacuum valving arrangement also comprises a seal arrangement angularly affixed to the one of the inner and outer tubes for defining the vacuum transfer zone and providing fluid communication between the vacuum chamber and the vacuum ports in the outer surface of the outer tube when the vacuum ports through the walls of the inner and outer tubes are disposed in alignment with one another in the vacuum transfer zone.

6. The apparatus of claim 5, wherein:

the vacuum ports in the inner tube are axially spaced from one another along the longitudinal axis, and at least one of the bearing elements extends at least partly over one of the vacuum ports in the inner tube to form an at least partly covered vacuum port in the inner tube;

the at least one bearing element having a vacuum passage extending through the at least one bearing element and providing fluid communication through the bearing element to the at least partly covered vacuum port when the vacuum passage through the at least one bearing element is aligned with the at least partly covered vacuum port in the inner tube.

7. The apparatus of claim 5, wherein, the vacuum ports in the inner tube are axially spaced from one another along the longitudinal axis, and at least some of the bearing elements are at least partially longitudinally disposed between adjacent ones of the vacuum ports in the inner tube.

8. The apparatus of claim 5, wherein, the vacuum valving arrangement is affixed to the inner tube and is not rotatable.

9. The apparatus of claim 8, wherein, the vacuum ports in the inner tube are axially spaced from one another along the longitudinal axis, and at least some of the bearing elements are at least partially longitudinally disposed between adjacent ones of the vacuum ports in the inner tube.

10. The apparatus of claim 9, wherein, the bearing elements are longitudinally disposed between adjacent ones of the vacuum ports in the inner tube.

11. The apparatus of claim 8, wherein, the seal arrangement includes first and second longitudinally extending seal elements, and first and second circumferentially extending seal elements, operatively mounted on the inner tube and joined in combination to define and sealingly encompass the vacuum transfer zone bounded by the seal elements.

12. The apparatus of claim 11, wherein, the first and second longitudinally extending seal elements define respective first and second axial ends thereof, with the first axial ends of the first and second longitudinally extending seals being juxtaposed and operatively connected by a first circumferentially extending seal element, and the second axial ends of the first and second longitudinally extending seals being juxtaposed and operatively connected by the second circumferentially extending seal element.

13. The apparatus of claim 11, wherein, the at least one vacuum port disposed in the vacuum transfer zone is a circumferentially extending slot to allow communication of vacuum through the wall of the inner tube over an angular arc of the wall of the inner tube.

14. The apparatus of claim 11, wherein, at least one of the bearing elements is disposed within the vacuum transfer zone.

15. The apparatus of claim 14, wherein:

at least two of the vacuum ports in the inner tube are disposed in a longitudinally spaced relationship to one another within the vacuum zone; and the at least one bearing element is longitudinally disposed between the at least two of the vacuum ports disposed in the longitudinally spaced relationship to one another within the vacuum transfer zone.

16. The apparatus of claim 15, wherein:

the inner tube defines a plurality of the vacuum ports therein disposed in a longitudinally spaced array with respect to one another within the vacuum transfer zone to form one or more pairs of adjacent longitudinally spaced vacuum ports of the inner tube; and at least one bearing element of the bearing arrangement is longitudinally disposed between the vacuum ports of each pair of adjacent vacuum ports within the vacuum transfer zone.

17. The apparatus of claim 16, wherein, the at least one vacuum port of the inner tube disposed in the vacuum transfer zone is a circumferentially extending slot to allow communication of vacuum through the wall of the inner tube over an angular arc of the wall of the inner tube.

18. The apparatus of claim 17, wherein, all of the plurality of vacuum ports in the longitudinally spaced array forming pairs of adjacent vacuum ports of the inner tube are circumferentially extending slots to allow passage of vacuum through the wall of the inner tube over angular arcs of the wall of the inner tube.

19. The apparatus of claim 16, wherein, the bearing elements of the bearing arrangement include a plurality of plurality of curved bearing pads extending partly around and individually attached to the outer surface of the inner tube in a circumferentially and longitudinally spaced relationship to one another to provide distributed support for the outer tube on the inner tube through 360 degrees of rotation of the outer tube.

20. The apparatus of claim 19, wherein, a plurality of the curved bearing pads are axially aligned with one another in a spaced relationship along the longitudinal axis.

21. The apparatus of claim 20, wherein, at least two of the curved bearing pads are axially aligned with one another within the vacuum transfer zone.

22. The apparatus of claim 19, wherein, the plurality of bearing pads forms at least two axially aligned rows of the bearing pads with the rows being attached to the inner tube in an evenly circumferentially spaced relationship to one another.

23. The apparatus of claim 22, wherein, one of the at least two axially aligned rows of bearing pads is disposed in the vacuum transfer zone.

24. The apparatus of claim 23, wherein, the at least one vacuum port of the inner tube disposed in the vacuum transfer zone is a circumferentially extending slot to allow passage of vacuum through the wall of the inner tube over an angular arc of the wall of the inner tube.

25. The apparatus of claim 24, wherein, the all of plurality of vacuum ports of the inner tube in the longitudinally spaced array forming pairs of adjacent vacuum ports in the vacuum transfer zone are circumferentially extending slots to allow passage of vacuum through the wall of the inner tube over angular arcs of the wall of the inner tube.

26. The apparatus of claim 5, further comprising at least one bearing element having a cylindrical shape disposed about the inner tube in the annular space between the inner and outer tubes.

27. The apparatus of claim 26, wherein, the cylindrical shaped bearing element is attached to and rotates with the outer tube.

28. The apparatus of claim 27, further comprising, a plurality of the cylindrical shaped bearing elements axially spaced from one another along the longitudinal axis.

29. The apparatus of claim 28, wherein, at least one of the plurality of the cylindrical shaped bearing elements is axially retained at a position along the longitudinal axis by an axial positioning arrangement operatively connecting the at least one cylindrical shaped bearing arrangement to the inner shaft.

30. The apparatus of claim 26, wherein, the at least one bearing element having a cylindrical shape further comprises at least part of the sealing arrangement.

31. The apparatus of claim 30, wherein, the at least one cylindrical shaped bearing element is disposed over at least one of the vacuum ports in the inner tube, to thereby form a cylindrical-shaped bearing/seal element that operatively seals at least a portion of the junctures of the inner and outer tubes with the cylindrical-shaped bearing/seal element.

32. The apparatus of claim 31, wherein, the cylindrical-shaped bearing/seal element is attached to and rotates with the outer tube.

33. The apparatus of claim 32, wherein, the apparatus further comprises a bearing/seal retention key extending through the outer tube and into engagement with the cylindrical-shaped bearing/seal element in a manner securing the cylindrical-shaped bearing/seal element to the outer tube for rotation therewith.

34. The apparatus of claim 33, wherein, the cylindrical-shaped bearing/seal element further comprises a longitudinally extending slot in an outer surface thereof configured for sliding passage of the retention key through the slot as the inner tube is axially installed into the outer tube and further configured to angularly secure the cylindrical -shaped bearing/seal element to the outer shaft for rotation therewith.

35. The apparatus of claim 34, wherein, the cylindrical-shaped bearing/seal element is axially retained at a position along the longitudinal axis by an axial positioning arrangement operatively connecting the cylindrical-shaped bearing/seal element to the inner shaft.

36. The apparatus of claim 35, wherein, the axial positioning arrangement comprises:

a retaining ring groove in the inner tube adjacent an axial end of the cylindrical-shaped bearing/seal element; and a retaining ring disposed in the groove and bearing against the axial end of the cylindrical-shaped bearing/seal element.

37. The apparatus of claim 32, wherein, the cylindrical-shaped bearing/seal element is axially retained at a position along the longitudinal axis by an axial positioning arrangement operatively connecting the cylindrical-shaped bearing/seal element to the inner shaft.

38. The apparatus of claim 37, wherein:

the cylindrical-shaped bearing/seal element is axially retained within the vacuum transfer zone at a position along the longitudinal axis by the axial positioning arrangement whereat the cylindrical-shaped bearing/seal element covers and seals around a corresponding vacuum port in the inner tube; and the cylindrical-shaped bearing/seal element includes a vacuum passage therein aligned in fluid communication with a corresponding vacuum port in the outer tube and providing fluid communication between the corresponding vacuum port in the outer tube and the corresponding vacuum port in the inner tube when the vacuum passage in the cylindrical-shaped bearing/seal element is in alignment with the corresponding vacuum port in the inner tube.

39. The apparatus of claim 38, wherein, the apparatus further comprises a bearing/seal retention key extending through the outer tube and into engagement with the cylindrical-shaped bearing/seal element in a manner securing the cylindrical-shaped bearing/seal element to the outer tube for rotation therewith, and also in a manner securing the cylindrical-shaped bearing/seal arrangement to the outer tube in an orientation whereat the vacuum passage in the cylindrical-shaped bearing/seal arrangement is disposed in fluid communication with the vacuum port in the outer tube.

40. The apparatus of claim 39, wherein, the cylindrical-shaped bearing/seal element further comprises a longitudinally extending slot in an outer surface thereof configured for sliding passage of the retention key through the slot as the inner tube is axially installed into the outer tube after the cylindrical-shaped bearing/seal arrangement has been axially fixed to the inner tube, and further configured to angularly secure the cylindrical-shaped bearing/seal element to the outer shaft for rotation therewith.

41. The apparatus of claim 32, further comprising, a plurality of the cylindrical-shaped bearing/seal elements axially spaced from one another along the longitudinal axis.

42. The apparatus of claim 41, wherein, at least one of the plurality of the cylindrical-shaped bearing/seal elements is axially retained at a position along the longitudinal axis by an axial positioning arrangement operatively connecting the at least one cylindrical shaped bearing arrangement to the inner shaft.

43. The apparatus of claim 42, wherein, the at least one of the plurality of cylindrical-shaped bearing/seal elements:

is axially retained at a position in the vacuum transfer zone along the longitudinal axis by the axial positioning arrangement whereat the cylindrical-shaped bearing/seal element covers and seals around a corresponding vacuum port in the inner tube; and includes a vacuum passage therein aligned with a corresponding vacuum port in the outer tube and providing fluid communication between the corresponding vacuum port in the outer tube and the corresponding vacuum port in the inner tube when the vacuum passage in the at least one of the plurality of cylindrical-shaped bearing/seal elements is in alignment with the corresponding vacuum port in the inner tube in the vacuum transfer zone.

44. The apparatus of claim 43, wherein:

each of the plurality of cylindrical-shaped bearing/seal elements further comprises a longitudinally extending slot in an outer surface thereof configured for sliding passage of the retention key through the slot as the inner tube is axially installed into the outer tube after the cylindrical-shaped bearing/seal arrangement has been axially fixed to the inner tube, and further configured to angularly secure the cylindrical-shaped bearing/seal element to the outer shaft for rotation therewith; and a plurality of bearing/seal retention keys, one for securing each of the cylindrical-shaped bearing/seal elements to the outer tube, extend through the outer tube in a longitudinally aligned spaced array and into the annular space between the inner and outer tubes to form an aligned row of distal ends of the keys which together define an interrupted key arrangement for engagement with the cylindrical-shaped bearing/seal elements in a manner securing each of the cylindrical-shaped bearing/seal elements to the outer tube for rotation therewith, and also in a manner securing the cylindrical-shaped bearing/seal arrangement to the outer tube in an orientation whereat the vacuum passage in the cylindrical-shaped bearing/seal arrangement is disposed in fluid communication with the vacuum port in the outer tube.

45. The apparatus of claim 44, wherein, the axial positioning arrangement comprises:

a retaining ring groove in the inner tube adjacent each axial end of each of the cylindrical-shaped bearing/seal elements; and a retaining ring disposed in each of the grooves and bearing against one or the other of the axial ends of the each of the cylindrical-shaped bearing/seal elements.

46. A method for providing both fluid communication between a fluid source and fluid ports on an outer surface of a rotatable processing roll and distributed bearing support of the processing roll along a longitudinal length of the processing roll, the method comprising, rotatably supporting an outer tube of the processing roll on a non-rotating inner tube of the processing roll with a fluid valving arrangement configured for providing angularly controlled transfer of fluid between a cavity on the inside of the inner tube and the fluid ports distributed longitudinally along an outer surface of the outer tube, with the cavity being connected to the fluid source, while the fluid valving arrangement is also providing distributed bearing support of one of the outer tube and the inner tube on the other of the outer and inner tube at a plurality of locations along a longitudinal axis of the processing roll;

wherein:

the non-rotatable inner tube extends along the longitudinal axis and the rotatable outer tube is disposed about the inner tube for rotation about the longitudinal axis with the inner and outer tubes defining an elongated annular space between the inner and outer tubes including a longitudinally elongated fluid transfer zone at a predetermined relative angular positioning of the outer tube with respect to the inner tube; and the fluid valving arrangement is disposed in the elongated annular space between the inner and outer tubes;

the inner tube defines an elongated fluid plenum therewithin extending along the longitudinal axis beneath the elongated fluid transfer zone, with the inner tube having at least one fluid port disposed therein providing fluid communication between the fluid transfer zone and the fluid plenum;

the outer tube includes a plurality of fluid ports distributed along the longitudinal axis on an outer surface of the outer tube and connected in fluid communication with the annular space between the inner and outer tubes;

the fluid valving arrangement is configured for providing angularly controlled transfer of fluid from the fluid plenum inside of the inner tube to the fluid ports distributed longitudinally along the outer surface of the outer tube, and also being configured for providing distributed bearing support of one of the outer tube and the inner tube on the other of the outer tube and the inner tube at a plurality of locations along the longitudinally elongated fluid transfer zone.

47. A processing roll apparatus providing both fluid communication between a fluid source and fluid ports on an outer surface of a rotatable processing roll and distributed bearing support of the processing roll along a longitudinal length of the processing roll, the apparatus comprising, rotatable outer tube of the processing roll supported on a non-rotating inner tube of the processing roll with a fluid valving arrangement configured for providing angularly controlled transfer of fluid between a cavity on the inside of the inner tube and the fluid ports distributed longitudinally along an outer surface of the outer tube, with the cavity being adapted for connection to the fluid source, while the fluid valving arrangement is also providing distributed bearing support of one of the outer tube and the inner tube on the other of the outer tube and the inner tube at a plurality of locations along a longitudinal axis of the processing roll;

wherein:

the non-rotatable inner tube extends along the longitudinal axis and the rotatable outer tube is disposed about the inner tube for rotation about the longitudinal axis with the inner and outer tubes defining an elongated annular space between the inner and outer tubes including a longitudinally elongated fluid transfer zone at a predetermined relative angular positioning of the outer tube with respect to the inner tube; and the fluid valving arrangement is disposed in the elongated annular space between the inner and outer tubes;

the inner tube defining an elongated fluid plenum therewithin extending along the longitudinal axis beneath the elongated fluid transfer zone, with the inner tube having at least one fluid port disposed therein providing fluid communication between the fluid transfer zone and the fluid plenum;

the outer tube including a plurality of fluid ports distributed along the longitudinal axis on an outer surface of the outer tube and connected in fluid communication with the annular space between the inner and outer tubes;

the fluid valving arrangement being configured for providing angularly controlled transfer of fluid from the fluid plenum inside of the inner tube to the fluid ports distributed longitudinally along the outer surface of the outer tube, and also being configured for providing distributed bearing support of one of the outer tube and the inner tube on the other of the outer tube and inner tube at a plurality of locations along the longitudinally elongated fluid transfer zone.

48. A method for providing distributed bearing support to an elongated rotatable roll, the method comprising:

journalling an outer tubular member of the roll defining a longitudinal axis of the roll on an inner non-rotatable member of the roll extending through the outer tubular member along the longitudinal axis, to define a longitudinally extending annular space between the inner and outer members of the roll, with a distributed bearing arrangement disposed in the annular space and having a plurality of axially spaced separately replaceable substantially cylindrical-shaped bearing elements secured to the outer member for rotation therewith:, securing the plurality of bearing elements to the inner member in an axially spaced relationship to one another along the longitudinal axis, in a manner precluding axial movement of the bearing elements along the longitudinal axis while allowing the bearing elements to rotate about the inner member;

securing the plurality of bearing elements to the outer member for rotation therewith;

securing the plurality of bearing elements to the outer member with a longitudinally extending key arrangement operatively engaging an outer surface of the bearing elements and an inner surface of the outer member;

forming a longitudinally extending slot in an outer surface of the bearing elements configured for engaging the distal end of a longitudinally extending key element protruding into the annular space from a wall of the outer member and having the distal end thereof configured for engaging the longitudinally extending slots in the bearing elements; and aligning the longitudinally extending slot in each one of the bearing elements with the key element as the each one of the bearing elements enters the annular space.

49. The method of claim 48, wherein the bearing elements have a longitudinal length thereof, the method further comprising:

forming a longitudinally extending slot in an outer surface of the bearing elements configured for engaging the distal ends of a plurality of distributed key elements extending through a wall of the outer member and having respective distal ends thereof configured for engaging the longitudinally extending slots in the bearing elements;

affixing the plurality of distributed key elements to the outer member in a longitudinally spaced array from one another along a line extending parallel to the longitudinal axis with the individual key members spaced from one another by a distance of less that the longitudinal length of the bearing elements; and aligning the longitudinally extending slot in each one of the bearing elements with the line of key elements as the each one of the bearing elements enters the annular space.

* * * * *